US008668807B2

(12) United States Patent
Rahman et al.

(10) Patent No.: US 8,668,807 B2
(45) Date of Patent: Mar. 11, 2014

(54) IONIC LIQUID SYSTEMS FOR THE PROCESSING OF BIOMASS, THEIR COMPONENTS AND/OR DERIVATIVES, AND MIXTURES THEREOF

(75) Inventors: Mustafizur Rahman, Tuscaloosa, AL (US); Hector Rodriguez, Belfast (GB); Ning Sun, Tuscaloosa, AL (US); Richard P. Swatloski, Tuscaloosa, AL (US); Daniel T. Daly, Tuscaloosa, AL (US); Robin D. Rogers, Tuscaloosa, AL (US)

(73) Assignee: Board of Trustees of The University of Alabama, Tuscaloosa, AL (US)

( * ) Notice: Subject to any disclaimer, the term of this patent is extended or adjusted under 35 U.S.C. 154(b) by 331 days.

(21) Appl. No.: 12/735,827

(22) PCT Filed: Feb. 18, 2009

(86) PCT No.: PCT/US2009/001066

§ 371 (c)(1),
(2), (4) Date: Aug. 19, 2010

(87) PCT Pub. No.: WO2009/105236

PCT Pub. Date: Aug. 27, 2009

(65) Prior Publication Data

US 2010/0319862 A1 Dec. 23, 2010

Related U.S. Application Data

(60) Provisional application No. 61/029,770, filed on Feb. 19, 2008.

(51) Int. Cl.
*D21C 3/20* (2006.01)

(52) U.S. Cl.
CPC ..... *D21C 3/20* (2013.01)
USPC ..... 162/72

(58) Field of Classification Search
CPC ..... D21C 3/20
USPC ..... 162/72
See application file for complete search history.

(56) References Cited

U.S. PATENT DOCUMENTS 1,943,176 A 1/1934 Graenacher
4,063,017 A 12/1977 Tsao et al.

(Continued)

FOREIGN PATENT DOCUMENTS

CA 2479941 10/2003
CH 153446 6/1932

(Continued)

OTHER PUBLICATIONS

Laine, Structures of Hemicelluloses and Pectins in Wood and Pulp, 2005, Helsinki University of Technology.*

(Continued)

*Primary Examiner* — Anthony Calandra
(74) *Attorney, Agent, or Firm* — Meunier Carlin & Curfman, LLC

(57) ABSTRACT

Disclosed herein are compositions and methods that involve ionic liquids and biomass. Multiphasic compositions involving ionic liquids and a polymer and uses of such compositions for fractioning various components of biomass are disclosed. Methods of making and using compositions comprising an ionic liquid, biomass, and a catalyst are also disclosed.

33 Claims, 4 Drawing Sheets

(56) References Cited

U.S. PATENT DOCUMENTS

| | | | |
|---|---|---|---|
| 4,097,666 | A | 6/1978 | Johnson et al. |
| 4,188,263 | A | 2/1980 | Hulsmann et al. |
| 4,520,105 | A | 5/1985 | Sinner et al. |
| 4,522,934 | A | 6/1985 | Shum et al. |
| 4,970,156 | A | 11/1990 | Avrameas et al. |
| 5,077,414 | A | 12/1991 | Arduengo, III |
| 5,679,146 | A | 10/1997 | Kalt et al. |
| 5,683,832 | A | 11/1997 | Bonhôte et al. |
| 5,714,536 | A | 2/1998 | Ziolo et al. |
| 5,747,125 | A | 5/1998 | Markulin |
| 5,792,399 | A | 8/1998 | Meister et al. |
| 5,827,602 | A | 10/1998 | Koch et al. |
| 5,856,513 | A | 1/1999 | Ue et al. |
| 6,376,712 | B2 | 4/2002 | Narizuka et al. |
| 6,451,220 | B1 | 9/2002 | Ziolo et al. |
| 6,613,310 | B1 | 9/2003 | Campbell et al. |
| 6,808,557 | B2 | 10/2004 | Holbrey et al. |
| 6,824,599 | B2 | 11/2004 | Swatloski et al. |
| 7,198,695 | B2 | 4/2007 | Kettenbach et al. |
| 7,253,289 | B2 | 8/2007 | Ren et al. |
| 7,550,520 | B2 | 6/2009 | Daly et al. |
| 8,030,030 | B2 | 10/2011 | Varanasi et al. |
| 8,038,840 | B2 | 10/2011 | Li |
| 8,044,120 | B2 | 10/2011 | D'Andola et al. |
| 8,110,667 | B2 | 2/2012 | Zhang et al. |
| 8,182,557 | B2 | 5/2012 | Argyropoulos |
| 2002/0010291 | A1 | 1/2002 | Murphy |
| 2003/0059604 | A1 | 3/2003 | Hattori et al. |
| 2003/0157351 | A1 | 8/2003 | Swatloski et al. |
| 2003/0165445 | A1 | 9/2003 | Malnou et al. |
| 2003/0233742 | A1 | 12/2003 | Jones et al. |
| 2004/0038031 | A1 | 2/2004 | Holbrey et al. |
| 2004/0077519 | A1 | 4/2004 | Price et al. |
| 2005/0061457 | A1 | 3/2005 | Skuratowicz |
| 2005/0123851 | A1 | 6/2005 | Shinbori et al. |
| 2005/0194561 | A1 | 9/2005 | Davis |
| 2005/0196671 | A1 | 9/2005 | Paonessa et al. |
| 2005/0285073 | A1 | 12/2005 | Singh et al. |
| 2005/0288484 | A1 | 12/2005 | Holbrey et al. |
| 2006/0118755 | A1 | 6/2006 | Fujioka et al. |
| 2006/0128996 | A1 | 6/2006 | Vaultier et al. |
| 2006/0194197 | A1 | 8/2006 | Spangler et al. |
| 2006/0241287 | A1* | 10/2006 | Hecht et al. ..... 530/356 |
| 2007/0006774 | A1 | 1/2007 | Rogers et al. |
| 2007/0112185 | A1 | 5/2007 | Myllymaki |
| 2007/0215300 | A1 | 9/2007 | Upfal et al. |
| 2007/0225191 | A1 | 9/2007 | Scheibel et al. |
| 2008/0023162 | A1 | 1/2008 | Myllymaki et al. |
| 2008/0190013 | A1 | 8/2008 | Argyropoulos |
| 2008/0227162 | A1 | 9/2008 | Varanasi et al. |
| 2008/0241536 | A1 | 10/2008 | Luo et al. |
| 2009/0088564 | A1 | 4/2009 | Luo et al. |
| 2010/0081798 | A1 | 4/2010 | Balensiefer et al. |
| 2010/0112646 | A1 | 5/2010 | Balensiefer et al. |
| 2010/0170504 | A1 | 7/2010 | Zhang |
| 2010/0196967 | A1 | 8/2010 | Edye et al. |
| 2010/0249432 | A1 | 9/2010 | Siemer et al. |
| 2010/0287826 | A1 | 11/2010 | Hoffman et al. |
| 2012/0245336 | A1 | 9/2012 | Daly et al. |

FOREIGN PATENT DOCUMENTS

| | | | |
|---|---|---|---|
| CN | 1380110 | | 11/2002 |
| DE | 2703703 | | 1/1977 |
| DE | 934308410 | | 3/1993 |
| EP | 0780391 | | 6/1997 |
| EP | 1222918 | | 7/2002 |
| EP | 1854786 | | 11/2007 |
| JP | 58183601 | | 10/1983 |
| JP | 63056501 | | 3/1988 |
| JP | 64017649 | | 1/1989 |
| JP | 80089796 | | 4/1996 |
| JP | 10265674 | | 10/1998 |
| JP | 2002290011 | | 10/2002 |
| JP | 2003171144 | | 6/2003 |
| JP | 2003335887 | | 11/2003 |
| WO | WO94/20521 | | 9/1994 |
| WO | WO95/21871 | | 8/1995 |
| WO | WO96/06593 | | 3/1996 |
| WO | WO00/32658 | | 6/2000 |
| WO | WO01/81436 | | 11/2001 |
| WO | WO02/079269 | | 10/2002 |
| WO | WO02/100360 | | 12/2002 |
| WO | WO02/102586 | | 12/2002 |
| WO | WO03/029329 | | 4/2003 |
| WO | WO03/041692 | | 5/2003 |
| WO | WO03/074031 | | 9/2003 |
| WO | WO2004/027897 | | 4/2004 |
| WO | W02005017252 | | 2/2005 |
| WO | WO 2005017001 | A1 * | 2/2005 |
| WO | 2006116126 | A2 | 11/2006 |
| WO | W02007005388 | | 1/2007 |
| WO | WO2007/063327 | | 6/2007 |
| WO | W02007111605 | A1 | 10/2007 |
| WO | WO2009/105236 | | 8/2009 |
| WO | WO2010/056790 | | 5/2010 |

OTHER PUBLICATIONS

Saitzyk, The Chemistry of Paper, 1987.Healy et al., Bioprocessing Marine Crustacean Shell Waste, 2003, Acta Biotechnol. 23 2-3, 151-160.*

International Search Report and Written Opinion for Application No. PCT/US2010/055381 dated Aug. 2, 2011.

Deng et al., Phase Diagram of [Amim]Cl +Salt Aqueous Biphasic Systems and Its Application for [Amim]Cl Recovery, J. Chem. Eng. Data, 54:2470-2473 (2009).

Fukuyama et al., A Copper-Free Sonogashira Coupling Reaction in Ionic Liquids and Its Application to a Microflow System for Efficient Catalyst Recycling, Org. Lett., 4(10):1691-1694 (2002).

Gutowski et al., Controlling the Aqueous Miscibility of Ionic Liquids: Aqueous Biphasic Systems of Water-Miscible Ionic Liquids and Water-Structuring Salts for Recycle, Metathesis, and Separations, J. Am. Chem. Soc., 125:6632-6633 (2003).

Mathews et al., Palladium catalysed Suzuki cross-coupling reactions in ambient temperature ionic liquids, Chem. Commun., 1249-1250 (2000).

Qin et al., Dissolution or extraction of crustacean shells using ionic liquids to obtain high molecular weight purified chitin and direct production of chitin films and fibers, Green Chem., 12:968-971 (2010).

Remsing et al., Mechanism of cellulose dissolution in the ionic liquid 1-n-butyl-3-methylimidazolium chloride: a 13C and 35/37Cl NMR relaxation study on model systems, Chem. Commun., 1271-1273 (2006).

Scurto et al., Carbon dioxide induced separation of ionic liquids and water, Chem. Commun., 572-573 (2003).

Stepnowski, Solid-phase extraction of room-temperature imidazolium ionic liquids from aqueous environmental samples, Anal. Bioanal. Chem., 381:189-193 (2005).

Sun et al., Complete dissolution and partial delignification of wood in the ionic liquid 1-ethyl-3-methylimidazolium acetate, Green Chem., 11:646-655 (2009).

Vijayaraghavan et al., An Assessment on the Interaction of a Hydrophilic Ionic Liquid with Different Sorbents, Ind. Eng. Chem. Res., 48:7283-7288 (2009).

Wu et al., Do we understand the recyclability of ionic liquids?, Chem. Eur. J., 15:1804-1810 (2009).

Al-Adhami et al , "Immobilization of Wood-Rotting Fungi Laccases on Modified Cellulose and Acrylic Carriers," J. Process Biochemistry, 37:1387-1394 (2002).

Ast et al., "Efficient Assembly of Peptomers on Continous Surfaces," *Tetrahedron Lett.*, (1999).

Benton et al., "Effect of Room-Temperature Ionic Liquids as Replacements for Volatile Organic Solvents in Free-Radical Polymerization," *Ionic Liquids*, 818:125-133 (2002).

Biedron et al., "Ionic Liquids as reaction Media for Polymeriazation Processes: Atom Transfer Radical Polymerization (ATRP) of Acrylates in Ionic Liquids," *Polymer Int'l*, 52(10):1584-1588 (2003).

(56) References Cited

OTHER PUBLICATIONS

Blankemeyer-Menge et al., "Simultaneous Multiple Synthesis of Protected Peptide Fragments on 'Allyl' -Functionalized Cellulose Disc Supports," *Tetrahedron Lett.*, 29:5871-5874 (1988).
Bonhôte et al., "Hydrophobic, Highly Conductive Ambient-Temperature Molten Salts," *Inorg. Chem.*,35:1168-1178 (1996).
Bora et al., "A Simple Method for Functionalization of Cellulose Membrane for Covalent Immoblization of Biomolecules," *J. Membr. Sci.*, 250:215-222 (2005).
Chesney et al., "Amino-Derivatised Beaded Cellulose Gels, Novel Accessible and Biodegradable Scavenger Resins for Solution Phase Cominatorial Synthesis," *Green Chem.*, 2:57-62 (2000).
Earle et al., "Ionic liquids. Green Solvents for the future," *Pure Appl. Chem.*, 72(7):1391-1398 (2000).
Endres, "Ionic Liquids: Solvents for the Eletrodeposition of Metals and Semiconductors," *Chem. Phys. Chem.*, 3(2):144-154 (2002).
Fannin et al., "Properties of 1,3-Dialkylimidazolium Chloride-Aluminum Choride Ionic Liquids. 2. Phase Transitions, Densities, Electrical Conductivities, and Viscosities," *J. Phys. Chem.*, 88:2614-2621 (1984).
Fischer et al., "Structural Changes of Cellulose Dissolved in Molten Salt Hydrates," *219th ACS National Meeting*, San Francisco, CA (2000) (abstract).
Froehner et al., "Properties of the Glycoprotein Laccase Imobilised by Two Methods," *Acta Chem Scand B*, 29:691-694 (1975).
Gelbrich, "Colloidal Structures Based on Topochemically Modified Cellulose," *Papier* (*Heidelberg* ) , 52:755-758 (1998).
Gemeiner, "Immobilized Enzymes, Organelles and Cells," In Enzyme Engineering, Gemeiner, Ed., Ellis Horwood Series in *Biochemistry and Biotechnology*, Ellis Horwood Limited: West Sussex, England, pp. 158-179 (1992).
Gordon et al., "Fused Organic Salts. 8. Properties of Molten Straight-Chain Isomers of Tetra-*n*-Pentylammonium Salts," *J. Amer. Chem. Soc.*, 100(24):7445-7454 (1978).
Harkin et al., "Lignification In Trees: Indication of Exclusive Peroxidase Participation," *Science*, 180:296-98 (1973).
Heinze et al., "Unconventional Methods in Cellulose Functionalization," *Prog. Polym. Sci.*, 26:1689-1762 (2001).
Hirayama, "Rapid Confirmation and Revision of the Primary Structure of Bovine Serum Albumin by ESIMS and Frit-FAB LC/MS," *Biochem. Biophys. Comm.*,173:639-646 (1990).
Holbrey et al., "The Phase Behaviour of 1-Alkyl-3-Methlimidazolium Tetrafluoroborates; Ionic Liquids and Ionic Liquid Crystals," *J. Chem. Soc. Dalton Trans.*,2133-2139 (1999).
Huddleston et al., "Characterization and Comparison of Hydrophilic and Hydrophobic Room Temperature Ionic Liquids Incorporating the Imidazolium Cation," *Green Chem.*, 3:156-164 (2001).
Huddleston et al., "Room Temperature Ionic Liquids as Novel Media for 'Clean' Liquid-Liquid Extraction," *Chem. Commun.*, 1765-1766 (1998).
Husemann et al., "Homogeneous Acetylation of Cellulose," *Buletinul Institutului Politehnic Din Lasi*, 1(1-2):47-51 (1970) (abstract).
Illanes et al., "Immobilization of Lactase and Invertase on Crosslinked Chitin," In Bioreactor Immobilized Enzymes and Cells, Moo-Young, Ed., *Elsevier Applied Science*: London, 233-249 (1998).
Illanes, "Stability of Biocatalysts," *Elec. J. Biotechnol.*, 2(1 ):1-9 (1999).
International Search Report and Written Opinion for PCT/US2009/64105, issued Jan. 13, 2010.
International Search Report and Written Opinion for PCT/US2009/01066, issued Jun. 22, 2009.
International Search Report and Written Opinion for PCT/US2006/24863 issued Jan. 3, 2007.
International Search Report and Written Opinion for PCT/US2006/020941 issued May 30, 2006.
International Search Report and Written Opinion for PCT/US2005/010235, issued Jan. 3, 2007.
Kirk-Othmer, *Encyclopedia of Chemical Technology*, 4'Ed., 5:476-563,1993.
Krajewska, "Application of Chitin- and Chitosan-based Materials for Enzyme Immobilizations: A Review," *Enz. Microb. Techno.*, 35:126-139 (2004).
Lau et al., "Dissolution of *Candida Antarctica* Lipase B in Ionic Liquids: Effects on Structure and Activity," *Green Chem.*, 6:483-487 (2004).
Lee et al., "Ionic Liquid-Mediated Selective Extraction of Lignin from Wood Leading to Enhanced Enzymatic Cellulose Hydrolysis," *Biotechnology and Bioengineering*, p. 1372, Table 2 (Oct. 24, 2008).
Leipner et al., "Structural Changes of Cellulose Dissolved in Molten Salt Hydrates," *Macromol Chem Phys*, 201(15):2041-2049 (2000).
Liebert et al., "Tailored Cellulose Esters: Synthesis and Structure Determination," *Biomacromolecules*, 6:333-340 (2005).
Linko et al., "Cellulose Bead Entrapped Microbial Cells Biotechnical Applications," *Enzyme Microb. Technol.*, 1:26-30 (1979).
Ma et al., "Reverse Atom Transfer Radical Polymerization of Methyl Methacrylate in Room-Temperature Ionic Liquids," *J. Polymer Sci. Pt. A-Polymer Chem.*, 41:143-151 (2003).
Maia et al., "Cellulose Organic Solvents. 1. The Structure of Anhydrous *N*Methylmorpholine *N*-Oxide and *N*-Methylmorphline *N*-Oxide Monohydrate," *Acta Cryst.*, B37:1858-1862 (1981).
Mais et al., "Modification of Cellulose Using Cellulose *p*-Toluene-Sulfonates as Intermediates," *Zeszyty Naukowe Politechniki Slaskiej Chemm.*, 140:121-125 (1999).
Marson et al., "A Novel, Efficient Procedure for Acylation of Cellulose Under Homogeneous Solution Conditions," *J. Appl. Polymer Sci.*, 74:1355-1360 (1999).
Mazurkiewicz et al., "Conducting Polymer Electrochemistry in Ionic Liquids," *Synthetic Metals*, 135:31-32 (2003).
Nara et al., "Lipase-Catalysed Polyester Synthesis in 1-Butyl-3-Methylimidazolium Hexafluorophosphate Ionic Liquid," *Tetrahedron Lett.*, 44:1371-1373 (2003).
Ngo et al., "Thermal Properties of Imidazolium Ionic Liquids," *Thermochimica Acta*, 357-358:97-102 (2000).
Ohno et al., "A New Type of Polymer Gel Electrolyte: Zwitterionic Liquid/Polar Polymer Mixture," *Electrochimica Acta*, 48:2079-2083 (2003).
Okamato et al., "Synthesis, Spectra, and Reactions of *N*-Triphenylmethylpyridinium Salts. Reactions of Triphenylmethyl Chlordie with Pyridine Under High Pressure," *J. Org. Chem.*, 35(11):3752-3756 (1970).
Padhye et al., "Cellulose Degradation in Xanthate Process," *J. App. Polymer Sci.* 36:1475-1478 (1988).
Perrier et al., "Reversible Addition—Fragmentation Chain Transfer Polymerization of Methacrylate, Acrylate and Styrene Monomers in 1-Alkyl-3-Methylimidazolium Hexfluorophosphate," *European Polymer J.*, 39(3):417-422 (2003).
Ren et al., "Synthesis of 1-Allyl-3-Methylimidazolium-Based Room Temperature Ionic Liquid and Preliminary Study of Its Dissolving Cellulose," *Acta Polymerica Sinica*, 3448-51 (2003) (abstract).
Sakai, "Determination of Pore Size and Pore Size Distribution," *J. Membr. Sci.*, 96:91-130 (1994).
Shriver et al., *Inorganic Chemistry*, W. H. Freeman & Co., New York, pp. 406-407 (1990).
Snedden et al., "Cross-Linked Polymer-Ionic Liquid Composite Materials," *Macromolecules*, 36(12):4549-4556 (2003).
Stöllner et al., "Activation of Cellulose Membranes with 1,1'-Carbonyldiimidazole or 1-Cyano-4-Dimethylaminopyridinium Tetrafluoroborate as a Basis for the Development of Immunosensors," *Anal. Biochem.*, 304:157-165 (2002).
Suarez et al., "Synthesis and Physical-Chemical Properties of Ionic Liquids Based on 1-*n*-Butyl-3-Methylimidazolium Cation," *J. Chim. Phys.*, 95:1626-1639 (1998).
Sun et al. "Magnetite-Embedded Cellulose Fibers Prepared From Ionic Liquid," *J. Mat. Chem.*, 18:283-290 (2008).
Supplemental Search Report for EP4757863, issued May 12, 2009.
Swatloski et al., "Dissolution of Cellulose with Ionic Liquids," *J. Am. Chem. Soc.*, 124:4974-4975 (2002).
Swatloski et al., "Ionic Liquids for the Dissolution and Regeneration of Cellulose," *In Molten Salts XIII: Proceedings of the International*

(56) References Cited

OTHER PUBLICATIONS

*Symposium*, Trulove, P.C., DeLong, H.C., Mantz, R.A., Stafford, G.R., Matsunaga, M., Eds., The Electrochemical Society: Pennington, NJ, 19:155-164 (2002).
Tiller et al., "A Novel Efficient Enzyme-Immobilization Reaction on $NH_2$ Polymers by Means of *L*-Ascorbic Acid," *Biotechnol. Appl. Biochem.*, 30:155-162 (1999).
Turner et al., "Production of Bioactive Cellulose Films Reconstituted from Ionic Liquids," *Biomacromolecules*, 5:1379-1384 (2004).
Turner, "Immobilization of Biocatalysts Using Novel IL-Reconstituted Cellulosic Support Materials," presentation on Apr. 19, 2005.
Visser et al. "Task Specific Ionic Liquids for the Extraction of Metal Ions from Aqueous Solutions," *Chem. Commun.*, 135-136 (2001).
Weckstrom et al., "Entrapment of Whole Cell Yeast β-Galactosidase in Precipated Cellulose Derivatives," *Food Process Eng.*, vol. 2, Applied Science Publishers Ltd., pp. 148-151 (1979).
Wilkes et al., "Air and Water Stable 1-Ethyl-3-methylimidazolium Based Ionic Liquids," *J. Chem. Soc. Chem. Commun.*,965-967 (1992).
Wu et al., "Homogeneous Acetylation of Cellulose in a New Ionic Liquid," *Biomacromol.*, 5:266-268 (2004).
Hasegawa et al., New Pretreatment Methods Combining a Hot Water Treatment and Water/Acetone Extraction for Thermo-Chemical Conversion of Biomass, Energy and Fuels, 18:755-760 (2004).
Kenealy et al., Pretreatments for Converting Wood into Paper and Chemicals, Materials, Chemicals and Energy from Forest Biomass; Argyropoulos, D.; ACS Symposium Series; American Chemical Society, Washington, DC, chapter 25, pp. 392-408 (2007).
Office Action for U.S. Appl. No. 13/129,060 dated Apr. 8, 2013.
Extended Search Report for Application No. EP09712508.2 dated Jun. 28, 2013.
Husemann et al., N-Athyl-pyridinium-chlorid als Losungmittel und Reaktionsmedium fur Cellulose, Die Makromolekulare Chemie, 128:288-291 (1969).
AxegÅrd, The Future Pulp Mill-A Biorefinery? Presentation at 1st International Biorefinery Workshop, Washington, DC., Jul. 20-21, 2005.
Bardeletti, Enzyme Immobilization on Polyethyleneimine-coated Magnetite Particles, Methodsin Biotech. I. Immobilization of Enzymes and Cells, pp. 133-141 (1997).
Cateto et al., Monitoring of lignin-based polyurethane synthesis by FTIR-ATR, Ind. Crops Prod., 27(2):168-174 (2008).
Deus et al., Partiell acetylierte Cellulose—Synthese and Bestimmung der Substituentenverteilung mit Hilfe der 1H NMR-Spektroskopie, Makromol. Chem., 192(1):75-83 (1991).
El Seoud et al., Applications of ionic liquids in carbohydrate chemistry: A window of opportunities, Biomacromol, 8 (9):2629-2647 (2007).
Extended European Search Report for Application No. 101778231.1 issued May 11, 2011.
Fischer et al, The behaviour of cellulose in hydrated melts of the composition LiX-nH2O (X=I-, NO-3, CH3COO-, ClO-4), Cellulose, 6:213-219 (1999).
Fort et al., Can ionic liquids dissolve wood? Processing and analysis of lignocellulosic materials with l-n-butyl-3-methylimidazolium chloride, Green Chem., 9:63-69 (2007).
Fukaya et al., Cellulose dissolution with polar ionic liquids under mild conditions: required factors for anions, Green Chem., 10:44-46 (2008).
Gallezot, Process options for converting renewable feedstocks to bioproducts, Green Chem., 9:295-302 (2007).
Hudson et al., The Solubility of Unmodified Cellulose: A Crtique of the Literature, J. Macromol. Sci. Rev. Macromol. Chem., 18(1):1-82 (1980).
Kilpeläinen et al., Dissolution of wood in ionic liquids, J. Agric. Food Chem., 55:9142-9148 (2007).
Manangeeswaran et al., Degradation of indulin, a kraft pine lignin, by Serratia marcescens, J. Environ. Sci. Health, Part B: Pesticides, Food Contaminants, and Agricultural Wastes, 42(3), 2007, p. 321-327.
Martin et al., Anisotropic magnetism in field-structured composites, Phys. Rev. E., 61(3):2818-2830 (2000).
Pu et al., Ionic liquid as a green solvent for lignin, J. Wood Chem. Technol, 27:23-33 (2007).
Rogers et al., Ionic Liquids—Solvents of the Future? Science, 302:792-793 (2003).
Willauer et al., Investigation of aqueous biphasic systems for the separation of lignins from cellulose in paper pulping process, J. Chromatogr. B: Biomed. Sci. Applic., 743(1-2):127-135, 2000.

* cited by examiner

IONIC LIQUID SYSTEMS FOR THE PROCESSING OF BIOMASS, THEIR COMPONENTS AND/OR DERIVATIVES, AND MIXTURES THEREOF

CROSS REFERENCE TO RELATED APPLICATIONS

This application claims the benefit of priority to U.S. Provisional Application 61/029,770, filed Feb. 19, 2008, which is incorporated by reference herein in its entirety.

BACKGROUND

With an ever-increasing awareness of global energy consumption and related environmental concerns, demands for "green" industrial processes are growing. An industrial move toward more environmentally benign practices may become inevitable as local and global credits for such practices become more mainstream, and, likewise, as anticipated "carbon taxes" drive markets away from environmentally malignant practices: One way of enhancing industrial environmental stewardship and avoiding these potential financial pitfalls is through the retrieval and use of biorenewable materials for industrial applications. Efficient and "green" biomass processing can, for example, transform relatively cheap, crude natural materials such as trees and crops into materials useful in a number of markets including paper and pulp, pharmaceuticals, and commodity chemicals, to name a few.

In paper and pulp industries, for example, a need exists for improved methods aimed at processing lignocellulosic biomass. Specifically, the fractionation and retrieval of both lignin and cellulose can be a difficult challenge, and a need exists for improved processes directed at the fractionation and extraction of these two components, particularly since the uses of both lignin and cellulose are so widespread. Cellulose, for example, is used as paper, glucose, and alcohol precursors, while lignin finds use in binders, dispersants, emulsifiers, and recently, in carbon fiber materials. With pulp mill sales reaching $34 billion during 2006 and annual growth rates for this industry projected to be between 2 and 8% in North and South America, it is readily apparent that a more efficient lignocellulosic biomass processing method could lead to increased profits for this industry.

Thus, a need for improved and "green" separation techniques for biomass, and more specifically, improved lignocellulosic biomass separation techniques, exists. This need and other needs are at least partially satisfied by the multiphasic compositions and methods of using such compositions disclosed herein.

SUMMARY

In accordance with the purposes of the disclosed materials, compounds, compositions, articles, and methods, as embodied and broadly described herein, the disclosed subject matter, in one example, relates to compounds and compositions and methods for preparing and using such compounds and compositions. In a further aspect, disclosed herein are compounds and compositions that form multiphasic compositions. In still a further aspect, disclosed herein are methods of using such multiphasic compositions to fractionate biomass. Also, disclosed herein are ionic liquid compositions comprising processing aids and biomass and methods for processing biomass. Still further, disclosed are compositions comprising two or more different ionic liquids and their use in processing biomass.

Additional advantages of the disclose subject matter will be set forth in part in the description that follows, and in part will be obvious from the description, or can be learned by practice of the aspects described below. The advantages described below will be realized and attained by means of the elements and combinations particularly pointed out in the appended claims. It is to be understood that both the foregoing general description and the following detailed description are exemplary and explanatory only and are not restrictive.

BRIEF DESCRIPTION OF THE FIGURES

The accompanying figures, which are incorporated in and constitute a part of this specification, illustrate several aspects described below.

DETAILED DESCRIPTION

Figure 1:
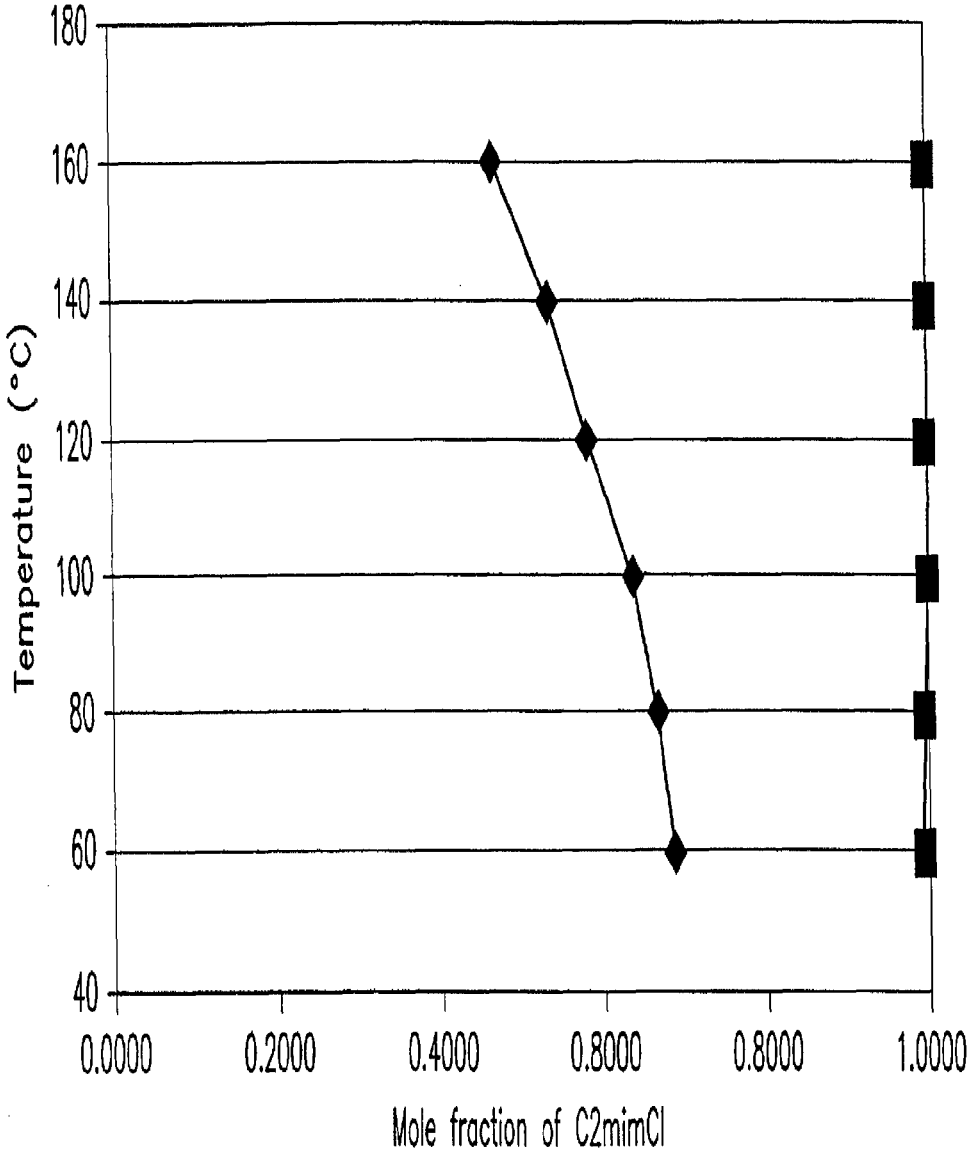
FIG. 1 is a temperature-composition diagram where the composition of the upper phase is represented by solid-diamonds (◆), the composition of the lower phase is represented by solid-squares (■), and the biphasic region corresponds to the area between the two lines.

The materials, compounds, compositions, and methods described herein may be understood more readily by reference to the following detailed description of specific aspects of the disclosed subject matter, the Figures, and the Examples included therein.

Before the present materials, compounds, compositions, and methods are disclosed and described, it is to be understood that the aspects described below are not limited to specific synthetic methods or specific reagents, as such may, of course, vary. It is also to be understood that the terminology used herein is for the purpose of describing particular aspects only and is not intended to be limiting.

Also, throughout this specification, various publications are referenced. The disclosures of these publications in their entireties are hereby incorporated by reference into this application in order to more fully describe the state of the art to which the disclosed matter pertains. The references disclosed are also individually and specifically incorporated by reference herein for the material contained in them that is discussed in the sentence in which the reference is relied upon.

DEFINITIONS

In this specification and in the claims that follow, reference will be made to a number of terms, which shall be defined to have the following meanings:

Throughout the specification and claims the word "comprise" and other forms of the word, such as "comprising" and "comprises," means including but not limited to, and is not intended to exclude, for example, other additives, components, integers, or steps.

As used in the description and the appended claims, the singular forms "a," "an," and "the" include plural referents unless the context clearly dictates otherwise. Thus, for example, reference to "a composition" includes mixtures of two or more such compositions, reference to "an agent" includes mixtures of two or more such agents, reference to "the component" includes mixtures of two or more such component, and the like.

"Optional" or "optionally" means that the subsequently described event or circumstance can or cannot occur, and that the description includes instances where the event or circumstance occurs and instances where it does not.

Ranges can be expressed herein as from "about" one particular value, and/or to "about" another particular value. "About" can mean within 5% of the stated value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "2000" is disclosed, then "about 2000" is also disclosed. It is also understood that when a value is disclosed, then "less than or equal to" the value, "greater than or equal to the value" and possible ranges between values are also disclosed, as appropriately understood by the skilled artisan. For example, if the value "2000" is disclosed, then "less than or equal to 2000" as well as "greater than or equal to 2000" is also disclosed. It is also understood that throughout the application data are provided in a number of different formats and that this data represent endpoints and starting points and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

References in the specification and concluding claims to parts by weight of a particular element or component in a composition denotes the weight relationship between the element or component and any other elements or components in the composition or article for which a part by weight is expressed. Thus, in a compound comprising 2 parts by weight of component X and 5 parts by weight component Y, X and Y are present at a weight ratio of 2:5, and are present in such ratio regardless of whether additional components are comprised in the composition.

A weight percent (wt. %) of a component, unless specifically stated to the contrary, is based on the total weight of the formulation or composition in which the component is included.

As used herein, the terms "fraction," "fractioning," and "fractionation" refer to a process comprising separating a mixture into quantities or components. If a mixture comprises, for example, two components, fractioning or fractionation of the mixture can comprise complete or partial separation of the two components. A "fractionation composition" is a composition that can be used to fraction a mixture.

As used herein, the term "substituted" is contemplated to include all permissible substituents of organic compounds. In a broad aspect, the permissible substituents include acyclic and cyclic, branched and unbranched, carbocyclic and heterocyclic, and aromatic and nonaromatic substituents of organic compounds. Illustrative substituents include, for example, those described below. The permissible substituents can be one or more and the same or different for appropriate organic compounds. For purposes of this disclosure, the heteroatoms, such as nitrogen, can have hydrogen substituents and/or any permissible substituents of organic compounds described herein which satisfy the valences of the heteroatoms. This disclosure is not intended to be limited in any manner by the permissible substituents of organic compounds. Also, the terms "substitution" or "substituted with" include the implicit proviso that such substitution is in accordance with permitted valence of the substituted atom and the substituent, and that the substitution results in a stable compound, e.g., a compound that does not spontaneously undergo transformation such as by rearrangement, cyclization, elimination, etc.

"$A^1$," "$A^2$," "$A^3$," and "$A^4$" are used herein as generic symbols to represent various substituents. These symbols can be any substituent, not limited to those disclosed herein, and when they are defined to be certain substituents in one sentence it does not mean that, in another sentence, they cannot be defined as some other substituents.

The term "alkyl" as used herein is a branched or unbranched saturated hydrocarbon group of 1 to 24 carbon atoms, such as methyl ($C_1$), ethyl ($C_2$), n-propyl ($C_3$), isopropyl ($C_3$), n-butyl ($C_4$), isobutyl ($C_4$), t-butyl ($C_4$), pentyl ($C_5$), hexyl ($C_6$), heptyl ($C_7$), octyl ($C_8$), nonyl ($C_9$), decyl ($C_{10}$), dodecyl ($C_{12}$), tetradecyl ($C_{14}$), hexadecyl ($C_{16}$), octadecyl ($C_{18}$), eicosyl ($C_{20}$), tetracosyl ($C_{24}$), and the like. The alkyl group can also be substituted or unsubstituted. The alkyl group can be substituted with one or more groups including, but not limited to, alkyl, halogenated alkyl, alkoxy, alkenyl, alkynyl, aryl, heteroaryl, aldehyde, amino, carboxylic acid, ester, ether, halide, hydroxy, ketone, nitro, silyl, sulfo-oxo, sulfonyl, sulfone, sulfoxide, or thiol, as described below. Abbreviations for various alkyl groups used herein are as follows: Me is methyl ($CH_3$), Et is ethyl ($C_2H_5$), Pr is propyl ($C_3H_7$), Bu is butyl ($C_4H_9$), etc.

Throughout the specification "alkyl" is generally used to refer to both unsubstituted alkyl groups and substituted alkyl groups; however, substituted alkyl groups are also specifically referred to herein by identifying the specific substituent(s) on the alkyl group. For example, the term "halogenated alkyl" specifically refers to an alkyl group that is substituted with one or more halides, e.g., fluorine, chlorine, bromine, or iodine. The term "alkoxyalkyl" specifically refers to an alkyl group that is substituted with one or more alkoxy groups, as described below. The term "alkylamino" specifically refers to an alkyl group that is substituted with one or more amino groups, as described below, and the like. When "alkyl" is used in one instance and a specific term such as "alkylalcohol" is used in another, it is not meant to imply that the term "alkyl" does not also refer to specific terms such as "alkylalcohol" and the like.

This practice is also used for other groups described herein. That is, while a term such as "cycloalkyl" refers to both unsubstituted and substituted cycloalkyl moieties, the substituted moieties can, in addition, be specifically identified herein; for example, a particular substituted cycloalkyl can be referred to as, e.g., an "alkylcycloalkyl." Similarly, a substituted alkoxy can be specifically referred to as, e.g., a "halogenated alkoxy," a particular substituted alkenyl can be, e.g., an "alkenylalcohol," and the like. Again, the practice of using a general term, such as "cycloalkyl," and a specific term, such as "alkylcycloalkyl," is not meant to imply that the general term does not also include the specific term.

The term "alkoxy" as used herein is an alkyl group bound through a single, terminal ether linkage.

The term alkoxylalkyl as used herein is an alkyl group that comprises an alkoxy substituent.

The term "alkenyl" or "alkene" or "alkylene" as used herein is a hydrocarbon group of from 2 to 24 carbon atoms with a structural formula comprising at least one carbon-carbon double bond. Asymmetric structures such as $(A^1A^2)C{=}C(A^3A^4)$ are intended to include both the E and Z isomers. This can be presumed in structural formulae herein wherein an asymmetric alkene is present, or it can be explicitly indicated by the bond symbol C═C. The alkenyl group can be substituted with one or more groups including, but not limited to, alkyl, halogenated alkyl, alkoxy, alkenyl, alkynyl, aryl, heteroaryl, aldehyde, amino, carboxylic acid, ester, ether, halide, hydroxy, ketone, nitro, silyl, sulfo-oxo, sulfonyl, sulfone, sulfoxide, or thiol, as described below.

The term "aryl" as used herein is a group that comprises any carbon-based aromatic group including, but not limited to, benzene, naphthalene, phenyl, biphenyl, phenoxybenzene, and the like. The term "aryl" also includes "heteroaryl," which is defined as a group that comprises an aromatic group that has at least one heteroatom incorporated within the ring of the aromatic group. Examples of heteroatoms include, but are not limited to, nitrogen, oxygen, sulfur, and phosphorus. Likewise, the term "non-heteroaryl," which is also included in the term "aryl," defines a group that comprises an aromatic group that does not comprise a heteroatom. The aryl group can be substituted or unsubstituted. The aryl group can be substituted with one or more groups including, but not limited to, alkyl, halogenated alkyl, alkoxy, alkenyl, alkynyl, aryl, heteroaryl, aldehyde, amino, carboxylic acid, ester, ether; halide, hydroxy, ketone, nitro, silyl, sulfo-oxo, sulfonyl, sulfone, sulfoxide, or thiol as described herein. The term "biaryl" is a specific type of aryl group and is included in the definition of aryl. Biaryl refers to two aryl groups that are bound together via a fused ring structure, as in naphthalene, or are attached via one or more carbon-carbon bonds, as in biphenyl.

The term "cycloalkyl" as used herein is a non-aromatic carbon-based ring composed of at least three carbon atoms. Examples of cycloalkyl groups include, but are not limited to, cyclopropyl, cyclobutyl, cyclopentyl, cyclohexyl, etc. The term "heterocycloalkyl" is a cycloalkyl group as defined above where at least one of the carbon atoms of the ring is substituted with a heteroatom such as, but not limited to, nitrogen, oxygen, sulfur, or phosphorus. The cycloalkyl group and heterocycloalkyl group can be substituted or unsubstituted. The cycloalkyl group and heterocycloalkyl group can be substituted with one or more groups including, but not limited to, alkyl, alkoxy, alkenyl, alkynyl, aryl, heteroaryl, aldehyde, amino, carboxylic acid, ester, ether, halide, hydroxy, ketone, nitro, silyl, sulfo-oxo, sulfonyl, sulfone, sulfoxide, or thiol as described herein.

The term "cyclic group" is used herein to refer to either aryl groups, non-aryl groups (i.e., cycloalkyl, heterocycloalkyl, cycloalkenyl, and heterocycloalkenyl groups), or both. Cyclic groups have one or more ring systems that can be substituted or unsubstituted. A cyclic group can comprise one or more aryl groups, one or more non-aryl groups, or one or more aryl groups and one or more non-aryl groups.

Unless stated to the contrary, a formula with chemical bonds shown only as solid lines and not as wedges or dashed lines contemplates each possible isomer, e.g., each enantiomer and diastereomer, and a mixture of isomers, such as a racemic or scalemic mixture.

The general term "polymer" includes homopolymer, copolymer, terpolymer, natural and synthetic polymers, biopolymers, fractionation polymers, etc. unless the context clearly dictates otherwise. When the prefix "poly" is used, reference is made to the product of polymerization of a monomer. Thus, the term "polyalkylene glycol" includes any polymerization product of the alkylene glycol monomer to which reference is made. The specific term "fractionation polymer" is used herein to identify a polymer that separates into its own phase when admixed with an ionic liquid at a given set of parameters, as are described herein for use in the disclosed multiphasic fractionation processes. This term is used as a mere aid to distinguish such polymers from among the various polymer components of biomass (e.g., polysaccharides proteins), which can be also present in the system.

Molecular weights can be expressed in units of molecular mass, i.e., g/mol, or more broadly in units of atomic mass, i.e., Daltons. These two unit expressions can be use interchangeably and, for the purposes of this disclosure, are synonymous. When in reference to a polymer, molecular weights can or cannot be the true molecular weight of the disclosed polymer. Also, disclosed polymer molecular weights can often represent a value advertised by a commercial supplier and/or molecular weights determined through reference of a polymer standard using, for example, liquid chromatography. This disclosure does not intend to be limited by this practice as those skilled in art are aware of these conventions.

Unless otherwise specified, a "molecular weight" of a polymer refers to the relative average chain length of the bulk polymer. In practice, molecular weight can be estimated or characterized in various ways including gel permeation chromatography (GPC) or capillary viscometry. GPC molecular weights are reported as the weight-average molecular weight (Mw) as opposed to the number-average molecular weight (Mn). Capillary viscometry provides estimates of molecular weight as the inherent viscosity determined from a dilute polymer solution using a particular set of concentration, temperature, and solvent conditions.

The term "number average molecular weight" ($M_n$) is defined herein as the mass of all polymer molecules divided by the number of polymer molecules which are present.

The term "weight average molecular weight" ($M_w$) is defined herein as the mass of a sample of a polymer divided by the total number of molecules that are present.

The term "polydispersity" or "polydispersity index" or "PDI" is defined herein as the weight average molecular weight, $M_w$, divided by the number average molecular weight, $M_n$.

The term "processing" is used herein to generally refer to the various treatments that a biomass can undergo, for example, physical treatments such as mixing, fractioning, drying, dying, and chemical treatments such as degradation, delignification, derivatization, functional group transformation (e.g., acetylation and deacetylation), fermentation, and the like.

Also, disclosed herein are materials, compounds, compositions, and components that can be used for, can be used in conjunction with, can be used in preparation for, or are products of the disclosed methods and compositions. These and other materials are disclosed herein, and it is understood that when combinations, subsets, interactions, groups, etc. of these materials are disclosed that while specific reference of each various individual and collective combinations and permutation of these compounds may not be explicitly disclosed, each is specifically contemplated and described herein. For example, if a composition is disclosed and a number of modifications that can be made to a number of components of the composition are discussed, each and every combination and permutation that are possible are specifically contemplated unless specifically indicated to the contrary. Thus, if a class of components A, B, and C are disclosed as well as a class of components D, E, and F and an example of a composition A-D is disclosed, then even if each is not individually recited, each is individually and collectively contemplated. Thus, in this example, each of the combinations A-E, A-F, B-D, B-E, B-F, C-D, C-E, and C-F are specifically contemplated and should be considered disclosed from disclosure of A, B, and C; D, E, and F; and the example combination A-D. Likewise, any subset or combination of these is also specifically contemplated and disclosed. Thus, for example, the sub-group of A-E, B-F, and C-E are specifically contemplated and should be considered disclosed from disclosure of A, B, and C; D, E, and F; and the example combination A-D. This concept applies to all aspects of this disclosure including, but not limited to, compositions and steps in methods of making and using the disclosed compositions. Thus, if there are a variety of additional steps that can be performed it is understood that each of these additional steps can be performed with any specific aspect or combination of aspects of the disclosed methods, and that each such combination is specifically contemplated and should be considered disclosed.

Reference will now be made in detail to specific aspects of the disclosed materials, compounds, compositions, components, devices, articles, and methods, examples of which are illustrated in the following description and examples, and in the figures and their previous and following description.

Materials and Methods

Disclose herein are various compositions and methods that involve the use of ionic liquids (ILs) and mixtures of ionic liquids for processing biomass. For example, in one embodiment, disclosed are compositions and methods for fractioning various components in biomass with a multiphasic IL/fractionation polymer system. In a further embodiment, ILs are used to dissolve biomass and processing aids in order to process and transform biomass and components thereof. In a still further embodiment, multiple IL systems comprising a biomass or components thereof are disclosed.

Multiphasic Fractionation

In one embodiment, disclosed herein are methods involving multiphasic (e.g., biphasic) compositions comprising an ionic liquid (IL) and a fractionation polymer, such as a polyalkylene glycol, in the substantial absence of water. The use of such compositions to fractionate biomass is also disclosed.

There are some published reports involving the use of polyalkylene glycol or its derivatives with aqueous IL solutions. For example, Visak et al., "Ionic Liquids in Polyethylene Glycol Aqueous Solutions: Salting-in and Salting-out Effects," *Monatshefte Fur Chemie* 2007, 138:1153, and Lopes et al., "Salting Effects in Ionic Liquid Aqueous Solutions: From Aqueous Biphasic System Formation to Salting Agent Precipitation," *Suppl Chemistry Today* 2007 25 37-39, disclose biphasic systems with aqueous ILs solutions (not neat ionic liquids) and polylethylene glycol. Typically, polyethylene glycols, which are polar, are soluble in ILs and do not form biphasic systems. These references produce aqueous biphasic systems by using water as a solvent and either the IL or the polyalkylene polymer as a solute. Additional salts further facilitates phase separation. These references do not focus on the immiscibility of neat IL and polymer, leading to multiphasic systems.

Disclosed herein are multiphasic (e.g., biphasic, triphasic, etc.) systems that comprise an IL and a fractionation polymer, both of which are substantially free of water. Thus, the disclosed fractionation composition is not an aqueous biphasic system. For example, the IL and fractionation polymer can each contain less than about 5, 4, 3, 2, 1, or 0.5 weight percent water, where any of the stated values can form an upper or lower endpoint. In another example, the combination of IL and fractionation polymer contains less than about 5, 4, 3, 2, 1, or 0.5 weight percent water, where any of the stated values can form an upper or lower endpoint.

As an example, polyethylene glycol with a molecular weight of 2000 Dalton (PEG-2000) and the ionic liquid 1-ethyl-3-methylimidazolium chloride ([$C_2$mim]Cl) forms a biphasic liquid system upon melting, when mixed as specific ratios, and over a wide temperature range. The following table summarizes the composition of each phase expressed as mole fraction of the ionic liquid, ($x_{IL}$) in equilibrium at the specified temperatures, as determined experimentally (see Example 6 herein).

TABLE 1

| Temperature (° C.) | $x_{IL}$ (upper phase) | $x_{IL}$ (lower phase) |
|---|---|---|
| 60 | 0.687 | 0.995 |
| 80 | 0.666 | 0.996 |
| 100 | 0.637 | 0.998 |
| 120 | 0.582 | 0.999 |
| 140 | 0.536 | 0.999 |
| 160 | 0.468 | 0.999 |

The corresponding temperature-composition diagram is shown in FIG. 1, where the composition of the upper phase is represented by solid-diamonds (◆), the composition of the lower phase is represented by solid-squares (■), and the biphasic region corresponds to the area between the two lines.

The disclosed compositions and methods, in one example, involve formation of a multiphasic system with IL and a fractionation polymer as a processing media for biomass, their components, and derivatives. Further, the creation of this type of multiphasic IL+fractionation polymer system is not limited to the mixture of just two compounds (i.e., one type of IL with one type of fractionation polymer), since combinations of ILs and/or fractionation polymers can be used. Thus, such biphasic systems can be created by mixing one or more than one suitable IL with one or more than one suitable fractionation polymer, in the appropriate proportions, so that the system partitions into distinct phases.

Moreover, the disclosed compositions and methods are not limited to the aforementioned mixtures for forming systems comprising just two phases. Any other stable polyphasic system, which can simplify the separation of biomass, is also disclosed. As such, systems with three, four, or more phases can be prepared and are contemplated herein.

Biomass

In the disclosed methods and compositions, biomass is used, fractioned, treated, derivitized, and/or otherwise processed. The term "biomass," as used herein, refers to living or dead biological material that can be used in one or more of the disclosed processes. Biomass can comprise any cellulosic or lignocellulosic material and includes materials comprising cellulose, and optionally further comprising hemicellulose, lignin, starch, oligosaccharides and/or monosaccharides, biopolymers, natural derivatives of biopolymers, their mixtures, and breakdown products (e.g., metabolites). Biomass can also comprise additional components, such as protein and/or lipid. Biomass can be derived from a single source, or biomass can comprise a mixture derived from more than one source. Some specific examples of biomass include, but are not limited to, bioenergy crops, agricultural residues, municipal solid waste, industrial solid waste, sludge from paper manufacture, yard waste, wood and forestry waste. Additional examples of biomass include, but are not limited to, corn grain, corn cobs, crop residues such as corn husks, corn stover, grasses, wheat, wheat straw, hay, rice straw, switchgrass, waste paper, sugar cane bagasse, sorghum, soy, components obtained from milling of grains, trees (e.g., pine), branches, roots, leaves, wood chips, wood pulp, sawdust, shrubs and bushes, vegetables, fruits, flowers, animal manure, multi-component feed, and crustacean biomass (i.e., chitinous biomass).

Ionic Liquids

Many in the art have turned to ILs (Rogers and Seddon, *Science* 2003, 302:792) to solve processing problems due to their non-volatility, solubilizing properties, recycling ability, and ease of processing. ILs can often be viable alternatives to traditional industrial solvents comprising volatile organic compounds (VOCs). In particular, the use of ILs can substantially limit the amount of organic contaminants released into the environment. As such, ILs are at the forefront of a growing field known as "green chemistry."

Cellulose, an often major component of biomass, has been shown to be capable of dissolution in ILs (Swatloski et al., *J Am Chem Soc* 2002, 124:4974-4975, PCT Publication No. WO03/029329 A2; Swatloski et al., "Ionic Liquids for the Dissolution and Regeneration of Cellulose," In Molten Salts XIII: Proceedings of the International Symposium, Trulove, et al., Eds., The Electrochemical Society: Pennington, N.J., 2002, Vol. 2002-19, pp. 155-164, which are incorporated by reference herein for at least their teachings of IL/cellulose dissolution). Components of biomass have also been reportedly dissolved in ILs (WO 05017252; Pu et al., "Ionic liquid as a green solvent for lignin," *J Wood Chem Technol,* 2007, 27:23-3, which are incorporated by reference herein in their entireties). It has even been demonstrated that both softwood and hardwood can be directly dissolved in a number of ILs (Fort et al., "Can ionic liquids dissolve wood? Processing and analysis of lignocellulosic materials with 1-n-butyl-3-methylimidazolium chloride," *Green Chem* 2007, 9:63-69; Kilpelainen et al., "Dissolution of wood in ionic liquids," *J Agric Food Chem* 2007, 55:9142-9148, which are incorporated by reference herein in their entireties). ILs have even been used as a delignification media that allows simultaneous dissolution and delignification of lignocellulosic biomass under microwave heating (see US Application Publication No. 2008/0023162, which is incorporated by reference herein in its entirety). The ionic liquids disclosed in these references can be used in the methods and compositions disclosed herein.

The ionic liquids that can be used in the disclosed methods and compositions comprise ionized species (i.e., cations and anions) and have melting points below about 150° C. For example, the disclosed ionic liquids can be liquid at or below a temperature of about 120° C. or about 100° C., and at or above a temperature of about minus 100° C. or about minus 44° C. For example, N-alkylisoquinolinium and N-alkylquinolinium halide salts have melting points of less than about 150° C. The melting point of N-methylisoquinolinium chloride is 183° C., and N-ethylquinolinium iodide has a melting point of 158° C. In other examples, a contemplated ionic liquid is liquid (molten) at or below a temperature of about 120° C. and above a temperature of about minus 44° C. In some examples, a suitable ionic liquid can be liquid (molten) at a temperature of about minus 10° C. to about 100° C.

Ionic liquids suitable for use herein can be hydrophilic or hydrophobic and can be substantially free of water, a water- or alcohol-miscible organic solvent, or nitrogen-comprising base. Contemplated organic solvents of which the ionic liquid is substantially free include solvents such as dimethyl sulfoxide, dimethyl formamide, acetamide, hexamethyl phosphoramide, water-soluble alcohols, ketones or aldehydes such as ethanol, methanol, 1- or 2-propanol, tert-butanol, acetone, methyl ethyl ketone, acetaldehyde, propionaldehyde, ethylene glycol, propylene glycol, the $C_1$-$C_4$ alkyl and alkoxy ethylene glycols and propylene glycols such as 2-methoxyethanol, 2-ethoxyethanol, 2-butoxyethanol, diethyleneglycol, and the like.

Cations

As noted, ionic liquids contain one or more types of cations and one or more types of anions. A suitable cation of a hydrophilic ionic liquid can be cyclic and correspond in structure to a formula shown below:

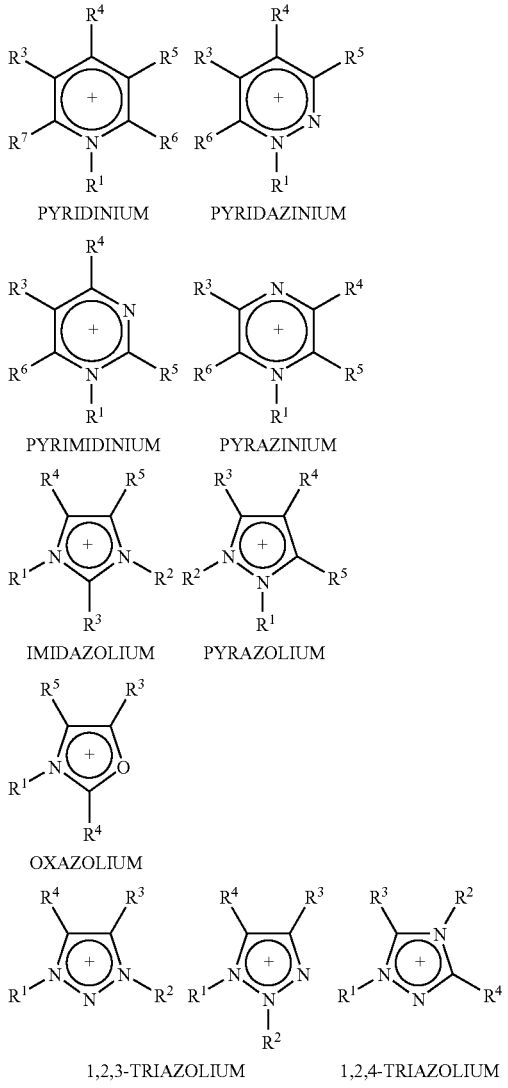

-continued

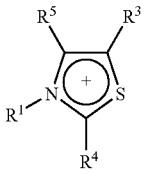

THIAZOLIUM

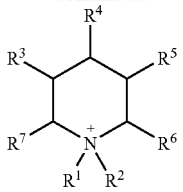

PIPERIDINIUM

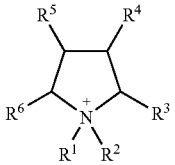

PYRROLIDINIUM

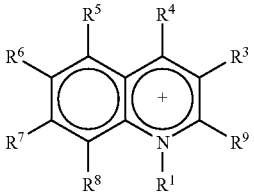

QUINOLIUM

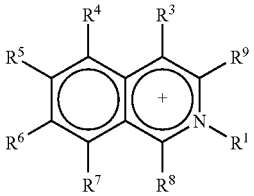

ISOQUINOLIUM wherein $R^1$ and $R^2$ are independently a $C_1$-$C_6$ alkyl group or a $C_1$-$C_6$ alkoxyalkyl group, and $R^3$, $R^4$, $R^5$, $R^6$, $R^7$, $R^8$, and $R^9$ ($R^3$-$R^9$), when present, are independently H, a $C_1$-$C_6$ alkyl, a $C_1$-$C_6$ alkoxyalkyl group, or a $C_1$-$C_6$ alkoxy group. In other examples, both $R^1$ and $R^2$ groups are $C_1$-$C_4$ alkyl, with one being methyl, and $R^3$-$R^9$, when present, are H. Exemplary $C_1$-$C_6$ alkyl groups and $C_1$-$C_4$ alkyl groups include methyl, ethyl, propyl, iso-propyl, butyl, sec-butyl, iso-butyl, pentyl, iso-pentyl, hexyl, 2-ethylbutyl, 2-methylpentyl, and the like. Corresponding $C_1$-$C_6$ alkoxy groups comprise the above $C_1$-$C_6$ alkyl group bonded to an oxygen atom that is also bonded to the cation ring. An alkoxyalkyl group comprises an ether group bonded to an alkyl group, and here comprises a total of up to six carbon atoms. It is to be noted that there are two isomeric 1,2,3-triazoles. In some examples, all R groups not required for cation formation can be H. Specific examples of such ILs for the dissolution of cellulose are disclosed in U.S. Pat. No. 6,824,599 and Swatloski et al., *J Am Chem Soc* 2002, 124:4974-4975, which are incorporated by reference herein for there teachings of ionic liquids.

The phrase "when present" is often used herein in regard to substituent R group because not all cations have all of the numbered R groups. All of the contemplated cations comprise at least four R groups, which can, in various examples, be H.

The phrases "substantial absence" and "substantially free" are used synonymously to mean that less than about 5 weight percent, more particularly less than about 1 weight percent, water or other referenced substance is present. For example, it has been reported in Swatloski et al., *J Am Chem Soc* 2002, 124:4974-4975, that cellulose is no longer soluble in certain ionic liquids if water content is above about 1 weight percent. It should be appreciated, however, that some water may be present since the biomass component is often only partially dry and the ionic liquid itself may contain residual amounts of water. Such residual amounts should be taken into account even though a system is described to be "substantially free of" or "substantially absent" water. The same meaning is intended regarding the presence of a nitrogen-comprising base, alcohol, or otherwise miscible organic solvent.

In one example, all R groups that are not required for cation formation; i.e., those other than $R^1$ and $R^2$ for compounds other than the imidazolium, pyrazolium, and triazolium cations shown above, are H. Thus, the cations shown above can have a structure that corresponds to a structure shown below, wherein $R^1$ and $R^2$ are as described before.

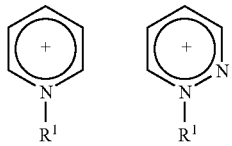

PYRIDINIUM

PYRIDAZINIUM

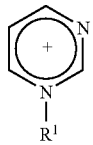

PYRIMIDINIUM

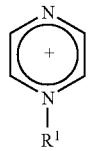

PYRAZINIUM

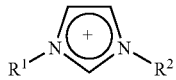

IMIDAZOLIUM

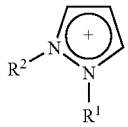

PYRAZOLIUM

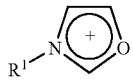

OXAZOLIUM

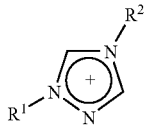

1,2,4-TRIAZOLIUM

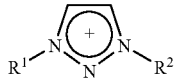

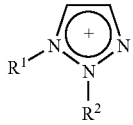

1,2,3-TRIAZOLIUM

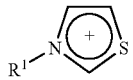

THIAZOLIUM

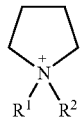

PYRROLIDINIUM

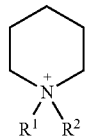

PIPERIDINIUM

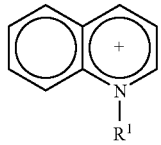

QUINOLIUM

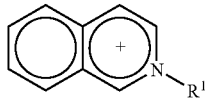

ISOQUINOLIUM

A cation that comprises a single five-membered ring that is free of fusion to other ring structures is also a suitable IL cation for the compositions and methods disclosed herein.

In additional examples, a cation of an ionic liquid can correspond in structure to a formula shown below:

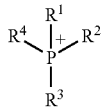

PHOSPHONIUM wherein $R^1$, $R^2$, $R^3$, and $R^4$, when present, are independently a $C_1$-$C_{18}$ alkyl group or a $C_1$-$C_{18}$ alkoxyalkyl group.

Still further examples of cations for suitable ILs include ammonium, alkoxyalkyl imidazolium, alkanolyl substituted ammonium, alkoxyalkyl substituted ammonium, aminoalkyl substituted ammonium.

Anions

An anion for a contemplated ionic liquid cation can be a halide (fluoride, chloride, bromide, or iodide), perchlorate, a pseudohalide, or $C_1$-$C_6$ carboxylate. Pseudohalides are monovalent and have properties similar to those of halides (Schriver et al., *Inorganic Chemistry*, W. H. Freeman & Co., New York, 1990, 406-407). Pseudohalides include the cyanide ($CN^-$), thiocyanate ($SCN^-$), cyanate ($OCN^-$), fulminate ($CNO^-$), azide ($N_3^-$), tetrafluoroborate ($BF_4$), and hexafluorophosphate ($PF_6$)anions.

Carboxylate anions that comprise 1-6 carbon atoms ($C_1$-$C_6$ carboxylate) are illustrated by formate, acetate, propionate, butyrate, hexanoate, maleate, fumarate, oxalate, lactate, pyruvate, and the like, are also suitable for appropriate contemplated ionic liquid cations. Further examples include sulfonated or halogenated carboxylates.

Sulfate anions, such as tosylate, mesylate, trifluoromethanesulfonate, trifluoroethane sulfonate, di-trifluoromethanesulfonyl amino, docusate, and xylenesulfonate (see WO2005017252, which is incorporated by reference herein for ionic liquids with anions derived from sulfonated aryls) are also suitable for use as the anionic component of an IL.

Still other examples of anions that can be present in the disclosed ILs include, but are not limited to, other sulfates, sulfites, phosphates, phosphonates (see Fukaya et al., *Green Chem,* 2008, 10:44-46), phosphites, nitrate, nitrites, hypochlorite, chlorite, perchlorate, bicarbonates, and the like, including mixtures thereof.

Specific Examples

Suitable ILs for the disclosed compositions and methods can comprise any of the cations and anions disclosed herein. For example, a suitable ionic liquid can be 1-alkyl-3-methylimidazolium halide, 1-alkyl-3-methylimidazolium $C_{1-6}$ carboxylate. Some specific examples of suitable ILs that can be used in the disclosed compositions and methods include, but are not limited to, allylmethylimidazolium Cl, allylbutylimidazolium Cl, diallylimidazolium Cl, allyloxymethylimidazolium Cl, allylhydroxyethylimidazolium Cl, allylmethylimidazolium formate, allylmethylimidazolium OAc, benzylmethylimidazolium Cl, bis(methylimidazolium)sulfoxide Cl, ethylmethylimidazolium benzoate, ethylmethylimidazolium $CF_3SO_3$, ethylmethylimidazolium Cl, ethylmethylimidazolium OAc, ethylmethylimidazolium xylenesulfonate, ethylmethylimidazolium methylphosphonate, propylmethylimidazolium formate, butylmethylimidazolium $BF_4$, butylmethylimidazolium Cl, butylmethylimidazolium Cl+$FeCl_3$, butylmethylimidazolium $MeSO_4$, butylmethylimidazolium $(CN_2)N$—, butylmethylimidazolium $PF_6$, butyl-2,3-dimethylimidazolium Cl, methylhydroxyethylimidazolium Cl, N,N'-dimethylimidazolium Cl, N,N'-dimethylimidazolium $MeSO_4$, N,N'-dimethylimidazolium OAc, 1-(2-hydroxylethyl)-3-methylimidazoium Cl, 1-methyl-3-(4-vinylbenzyl)imidazolium Cl, 3,3-ethane-1,2-dylbis(methylimidazolium)dichloride, 3,3-ethane-1,2-dylbis(methylimidazolium)dichloroaluminate, 1-vinyl-3-(4-vinylbenzyl)imidazolium Cl, diethyl N-methyl-N-(2-methoxyethyl)ammonium $Tf_2N$, hydroxybutyl trimethylammonium carbamate, nitronium $Tf_2N$, tetrabutylammonium benzoate, tetrabutylammonium, dodecylbenzenesulfonate, tetrabutylammonium OH, tetrabutylammonium xylenesulfonate, phenyltributylammonium xylenesulfonate, allylmethylpyridinium Cl, benzylpyridinium Cl, butylmethyl pyrrolidinium 4-hydroxybenzenesulfonate, ethylpyridinium Br, trihexyltetradecylphosphonium xylenesulfonate, choline Cl+urea, choline Cl+$ZnCl_2$.

Some additional examples of ionic liquids include, but are not limited to, the following quaternary ammonium salts: $Bu_4NOH$, $Bu_4N(H_2PO_4)$, $Me_4NOH$, $Me_4NCl$, $Et_4NPF_6$, and $Et_4NCl$.

In various examples disclosed herein, biomass, optionally including cellulose and other biopolymers, can be partially or completely dissolved with or without derivatization in the disclosed fractionation compositions comprising ionic liquids and fractionation polymer. A contemplated solution of biomass in the ionic liquid portion of the fractionation composition can contain cellulose in an amount of from about 5 to about 35 wt. %, from about 5 to about 25 wt. %, from about 5 to about 20 wt. %, from about 5 to about 15 wt. %, from about 10 to about 35 wt. %, from about 10 to about 25 wt. %, from about 15 to about 35 wt. %, or from about 15 to about 25 wt. % of the solution. In other examples, the ionic liquid can contain cellulose in an amount of about 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, or 35 wt. % of the solution, where any of the stated values can form an upper or lower endpoint. Further, a solution of biomass in an ionic liquid can contain cellulose in an amount of from about 5 to about 35 parts by weight, from about 5 to about 25 parts by weight, from about 5 to about 20 parts by weight, from about 5 to about 15 parts by weight, from about 10 to about 35 parts by weight, from about 10 to about 25 parts by weight, from about 15 to about 35 parts by weight, or from about 15 to about 25 parts by weight of the solution. In other examples, the ionic liquid can contain cellulose in an amount of about 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, or 35 parts by weight of the solution, where any of the stated values can form an upper or lower endpoint.

The disclosed fractionation compositions and methods can also comprise mixtures of two, or more, ILs in any suitable combination. In certain examples, one can use one IL that is selective for cellulose and another IL (miscible or immiscible with the first) that is selective for lignin.

Fractionation Polymers

Polyalkylene Glycols

In the various examples disclosed herein, polyalkylene glycols can be used as components along with ILs in the disclosed multiphasic fractionation compositions. In one example, a polyalkylene glycol can be used to extract at least a portion of lignin from a stock of lignocellulosic biomass. Polyalkylene glycols have been previously shown to dissolve lignin from wood to form an aqueous biphasic system (Guo et al., *Ind. Eng. Chem. Res.* 2002, 2535). Similarly, according to the subject matter disclosed herein, polyalkylene glycols can be suitable components in the disclosed multiphasic compositions.

One example of polyalkylene glycols relates to polyethylene glycols (PEG) (also known as polyethylene oxide, PEO) having the formula:

$$HO(CH_2CH_2O)_xH$$

wherein the index x represent the average number of ethyleneoxy units in the polyalkylene glycol. The index x can be represented by a whole number or a fraction. For example, a polyethylene glycol having an average molecular weight of 8,000 g/mol (PEG 8000) can be equally represented by the formulae:

$$HO(CH_2CH_2O)_{181}H \text{ or } HO(CH_2CH_2O)_{181.4}H$$

or the polyethylene glycol can be represented by the common short hand notation: PEG 8000. This notation, common to one skilled in the art, is used interchangeably throughout the specification to indicate polyethylene glycols and their average molecular weight. The formulator will understand that depending upon the source of the polyethylene glycol, the range of molecular weights found within a particular sample or lot can range over more or less values of x. For example, one source of PEG 8000 can include polymers wherein the value of x can be from about 175 to about 187, whereas another source can report the range of molecular weights such that x can be from about 177 to about 184. In fact, the formulator, depending upon the desired use of a particular fractionation composition, can form an admixture of different polyethylene glycols in varying amounts in a final composition. For example, 2% by weight of the composition comprises PEG 4000 and 2% by weight of the composition comprises PEG 8000 for a total of 4% by weight of the total composition.

One non-limiting example of a fractionation polymer includes polyethylene glycols having an average molecular weight from about 2,000 g/mol to about 20,000 g/mol. A further example includes polyethylene glycols having an average molecular weight from about 2,000 g/mol to about 8,000 g/mol. Another example includes polyethylene glycols having an average molecular weight from about 2,000 g/mol to about 4,600 g/mol. Still another non-limiting example of a suitable fractionation polymer is a polyethylene glycol having an average molecular weigh of about 2,000 g/mol to about 3,400 g/mol.

Another example of polyalkylene glycols relates to polypropylene glycols (PPG) (also known as polypropylene oxide, PPO) having the formula:

$$HO[CH(CH_3)CH_2O]_xH$$

wherein the index x represent the average number of propyleneoxy units in the polyalkylene glycol. As in the case of ethylene glycols, for propylene glycols the index x can be represented by a whole number or a fraction. For example, a polypropylene glycol having an average molecular weight of 8,000 g/mole (PEG 8000) can be equally represented by the formulae:

$$HO[CH(CH_3)CH_2O]_{138}H \text{ or } HO[CH(CH_3)CH_2O]_{137.6}H$$

or the polypropylene glycol can be represented by the common, short hand notation: PPG 8000.

One non-limiting example of fractionation polymer can include polypropylene glycols having an average molecular weight from about 2000 g/mol to about 20,000 g/mol. A further example includes the polypropylene glycols having an average molecular weight from about 2000 g/mol to about 12,000 g/mol. Another example includes the polypropylene glycols having an average molecular weight from about 2000 g/mol to about 8,000 g/mol. One non-limiting example of a fractionation polymer is a polypropylene glycol having an average molecular weigh of about 2,000 g/mol to about 4,600 g/mol.

Polypropylene glycols can be admixed with polyethylene glycols to form a suitable biphasic system for the compositions disclosed herein.

A further example of suitable composition includes poloxamers having the formula:

$$HO(CH_2CH_2)_{y1}(CH_2CH_2CH_2O)_{y2}(CH_2CH_2O)_{y3}OH$$

these are nonionic block copolymers composed of a polypropyleneoxy unit flanked by two polyethyleneoxy units. The indices $y^1$, $y^2$, and $y^3$ have values such that the poloxamer has an average molecular weight of from about 2000 g/mol to about 20,000 g/mol. These polymers are also well known by the trade name PLURONICS™. These compounds are commonly named with the word Poloxamer followed by a number to indicate the specific co-polymer, for example Poloxamer 407 having two PEG blocks of about 101 units ($y^1$ and $y^3$ each equal to 101) and a polypropylene block of about 56 units. This polymer is available from BASF under the trade name LUTROL™ F-17.

Some other specific examples of polyalkylene glycols include, poly(ethylene glycol, including ester derivatives thereof, such as its methyl ester or the esters of fatty acids (e.g., PEG-palmitate). Block polymers of the type PEO-PPO-PEO, and random PEO-PPO polymers can be used. Further, Triton-X-100 (polyethylene glycol p-(1,1,3,3-tetramethylbutyl)-phenyl ether), which is non-ionic surfactant that comprises a polyethylene glycol moiety, can also be used herein as a fractionation polymer.

Additional Fractionation Polymers

Further examples of fractionation polymers that can be used include, but are not limited to, polyethyleneimine (PEI), polybutyletheramine, poly(N-isopropylacrylamide) (PNIPAM), copolymers of PNIPAM with polyvinylimidazole, polysaccharides like dextran and derivatives thereof, cellulose derivatives, pectin, Ficoll, hydroxypropyl starch, polyvinyl alcohol (PVOH, PVA, or PVAL), copolymers of PVCL with polyvinylimidazole, polyvinylcaprolactam (PVCL), polyvinylpyrrolidone (PVP), Also included are polymers derived from those listed herein, for example, aliphatic ester derivatives.

Biopolymers such as proteins (e.g., ovalbumin and derivatives thereof), oligopeptides and homopolymers of single amino acids (e.g., polylysine) can be used.

Other suitable fractionation polymers not specifically described herein are also suitable for use in the compositions and methods of using the same.

Ionic Liquid/Fractionation Polymer Systems

In various examples disclosed herein, an IL can be mixed with an appropriate fractionation polymer, preferably a polyalkylene glycol, to form a fractionation composition. In several examples, an ionic liquid can be mixed with polyethylene glycol or polypropylene glycol, or a mixture or derivative thereof, with a molecular weight as previously described above, to form a fractionation composition. Into the fractionation composition can be added a biomass. The biomass can be added to the IL and/or the fractionation polymer prior to admixing the IL and fractionation polymer together, or alternatively, the biomass can be added to the fractionation composition.

The fractionation composition can form a multiphasic (e.g., biphasic) composition under a given set of external parameters, such as, for example, temperature and pressure, and form a monophasic composition under a slightly different set of external parameters. As such, the disclosed compositions and methods are not intended to be limited by the ability or inability of a given composition to form a biphasic mixture at a specific condition.

Techniques can be employed to facilitate mixing and subsequent phase separation between a fractionation polymer and an IL. For example, a mixture of an ionic liquid and a fractionation polymer (with our without the biomass component) can be agitated, shaken, stirred, vortexed, sonicated, centrifuged or otherwise treated to induce substantially complete mixing of components. Typically, the degree of homogenization is controlled by the regulation of the mixing speed. The mixture can also be heated by, for example, hot plate, hot bath, microwave irradiation, infrared irradiation, and ultrasound irradiation. In further examples, additives can be used to assist component mixture. Examples of such additives include surfactants, processing aids (e.g., catalysts), or combinations thereof.

Once a substantially homogenized mixture is obtained, techniques can be further employed to induce phase separation of the components. For example, a heated mixture of a fractionation polymer and IL can be cooled to induce phase separation. Likewise, in a further example, the stirring speed for the mixture can be reduced. In other examples, a reduction of both stirring speed and temperature can be used to induce phase separation. In other examples, additives such as surfactants, processing aids, or combinations thereof can be added to a substantially homogenized mixture to induce phase separation. These additives can be used independently, or in conjunction with other methods, such as cooling and/or adjusting the mixing speed.

Components of the various fractionation compositions disclosed herein can be present in various weight ratios with respect to the mixture or with respect to individual components. An IL and a fractionation polymer can be present in weight ratios of from about 5:95 (wt:wt) to about 95:5 (wt:wt). In one example, an IL and a fractionation polymer can be present at a ratio of about 50:50 (wt:wt). In other examples, an IL and a fractionation polymer can be present at a ratio of about 10:90, 15:85, 20:80, 25:75, 30:70, 35:65, 40:60, 45:55, and of about 55:45, 60:40, 65:35, 70:30, 75:25, 80:20, 85:15, 90:10, all expressed in terms of wt:wt. Such ratios, however, are intended to be exemplary, and other suitable ratios are specifically contemplated.

Specific components of the disclosed fractionation compositions can be selected based on their properties to induce a phase separation or lack thereof. For example, if a hydrophilic IL is selected from among the group previously disclosed, a suitable complementary fractionation polymer can be one with an appropriate hydrophobicity such that an immiscible mixture can be obtained. In general, hydrophilicity of polyalkylene glycol is inversely proportional to molecular weight. One skilled in the art could select an appropriate molecular weight for a polyalkylene glycol based on the extent of hydrophobicity desired.

Mixtures of an IL and a fractionation polymer like a polyalkylene glycol can optionally comprise other components. For example, processing aids catalysts and/or surfactants can be present to enhance phase separation and/or desired component separation from within the mixture. For example, in a specific example, a surfactant, TRITON™-X-100 (Acros Organics), can be added to a particular biphasic composition to induce, promote, or otherwise aid a biphasic separation process. Likewise, IL and fractionation polymer mixtures can comprise other additives if a need for such an additive in a particular application arises.

Uses of the ionic liquid/fractionation polymer systems disclosed herein include, but are not limited to, biomass fractioning processes. In one example, a biphasic polyalkylene glycol/IL system can be used to separate biomass rich in lignocellulosic material. The lignocellulosic material can be obtained from, for example, wood pulp. It has been shown and previously described above that ILs can dissolve cellulose. Cellulose, however, has limited to no solubility in the fractionation polymers discussed above, such as, for example, polyalkylene glycol. Lignin, on the other hand, is at least partially soluble in fractionation polymers like polyalkylene glycol and substantially less soluble in at least some of the ILs disclosed herein. Thus, a biphasic mixture comprising an ionic liquid and a polyalkylene glycol can be used to at least partially fractionate lignin from cellulose from a crude stock of lignocellulosic biomass. Table 2 lists the solubility of both lignin and cellulosic materials in various selected polyalkylene glycols. The results listed in Table 2 show that upon phase separation the lignin portion of lignocellulosic material can be driven into a polyalkylene glycol phase, while a cellulose portion remains in an ionic liquid phase.

TABLE 2

Solubility (wt %) of lignin and cellulose standards in polyalkylene glycols of different molecular weights at 70° C.

| Polyalkylene glycol | Lignin[a] | Cellulose[b] |
|---|---|---|
| PEG 300 | >15 | <1 |
| PEG 600 | >15 | <1 |
| PEG 3400 | >15 | <1 |
| PEG 4600 | >15 | <1 |

[a]Indulin AT derived from Kraft pulping process;
[b]microcrystalline cellulose.

In other examples, biomass can be processed and extracted with the presently disclosed fractionation compositions. For example, tree bark, sawdust, wood chips, wood pulp or any other crude material comprising wood, can be added to a mixture of an ionic liquid and a polyalkylene glycol, and upon phase separation of the mixture, each phase can be separated from the other phase. The resulting composition of each individual phase can be treated in any manner to remove, recover, reconstitute, or store the desired component. Cellulose, for, example, if present in one of the separated phases, can be processed according to the methods disclosed in U.S. Pat. No. 6,824,599, which is incorporated by reference herein.

In the various examples provided herein, extractions of particular materials can be performed using a variety of methods. Most extraction methods contemplated follow standard protocol and involve methods such as filtration and precipitation.

Processing of Biomass in ILs

In a further embodiment, ILs are used to dissolve or suspend one or more processing aids used for delignification, derivatization, controlled disintegration, and/or many other biomass processing techniques. This technique can be use prior to, after, or separate from the fractionation process disclosed above, which involve the use of a fractionation polymer. Since ILs can dissolve major components of biomass (e.g., cellulose) without any pretreatment, ILs with dissolved/suspended processing aids or other additives, can allow simultaneous dissolution and processing of biomass. As such, in many examples herein, disclosed are methods and compositions that involve the processing of biomass (or its components) in one or more ILs and with one or more processing aids that are simultaneously dissolved (or suspended) in the IL.

In this particular embodiment, any of the ionic liquids and mixtures thereof disclosed above for the multiphasic fractionation can also be used. Furthermore, any of the biomass materials discussed above can be processed herein according to this embodiment.

In a specific example of this embodiment, a biomass (e.g., lignocellulosic, crustacean, or other type of biomass) is completely or partially dissolved or suspended in an ILs at up to 50 wt %. A processing aid can already be present in the IL or can be added after the biomass is dissolved. The catalysts and any optional additives can be used to increase dissolution, facilitate disintegration, cleave bonds, separate biopolymers from biomass, and for derivatization and other treatments of biomass and their components.

Depending on the processing aids, the mixture can be heated up to about 150° C. Such heating can involve microwave, infrared, or ultrasound irradiation, and/or other external sources of energy supply. Heating can be performed for up to 16 hours or longer. Reactions can be held in air or under inert environment depending on catalyst(s) and additive(s) used.

All the components of biomass can be dissolved simultaneously (or selectively) and regenerated separately later using appropriate regeneration solvents. Likewise, the processing aids can be recovered from the solution and re-used.

Processing Aids

Processing aids can be added to the system in order to stiochiometrically/nonstoichiometrically interact with biomass or their biopolymer components to increase dissolution, facilitate disintegration, cleave bonds, delignifying, fermentate, separate biopolymers from biomass, and for derivatization and other treatments of biomass and their components. Any processing aid can be used in these methods as long as the ionic liquid media does not inactivate the processing aid. Suitable processing aids are those that can selectively cleave lignin from lignocellulosic biomass or degrade a biopolymer component of biomass (e.g., fermentation of sugars into ethanol). Some specific examples of processing aids, include but are not limited to, catalysts, metal salts, polyoxymetalates (POMs) (e.g., $H_5[PV_2Mo_{10}O_{40}]$), anthraquinone, enzymes, and the like. Dichloro dicyano quinone (DDQ) is an example of one type of processing aid that can selectively cleave lignocellulosic bonds in solution and help separating components of lignocellulosic biomass. In many examples, the processing aid is a metal ion catalyst used to cleave lignocellulosic bonds. Also, contemplated herein are processing aids like microwave or thermal irradiation. Such aids can likewise be used to break bonds in a biomass material present in an IL.

Multiple-IL Systems

In a still further embodiment, a mixture of two or more different ILs can be used as media for processing biomass and its components. That is, ILs with specific properties can be mixed together to yield a media with desired properties required for processing a wide variety of biomass materials. For example, one can use a first IL that is selective for lignin to delignify a lignocellulosic biomass, whereas another IL (whether miscible or immiscible with the first IL) can be used to dissolve cellulose. Both ILs can be present in the multiple-IL system. Such multi-IL systems can be used directly for processing biomass or, alternatively, they can be combined with a fractionation polymer in order to fraction certain components in the biomass, as disclosed above.

While dissolution of cellulose and whole lignocellulosic biomass have been reported, selective dissolution of lignin, another major component of lignocellulosic biomass, have been demonstrated in several ILs with sulfonated anionic groups (WO 05017252). There has been one instance where more than one IL were mixed together (CN1818160, which are incorporated by reference herein). In this document, 1-butyl-3-methyimidazolium chloride ($C_4$mimCl) was used to dissolve high concentrations of cellulose for preparing spinning dope and 1-butyl-3-methyimidazolium tetrafluoroborate ($C_4$mim$BF_4$) was used to lower the viscosity of the solution so that the dissolution process required less time and energy. The mixture of these two ILs was disclosed for this specific application for a range of degree of polymerization of cellulose and cooking temperature. Meanwhile, Arce et al. reported a system composed of two mutually immiscible ILs (Arce et al., "Mutually immiscible ionic liquids," *Chem Commun* 2006, 2548-2550; and *Fluid Phase Equilib* 2007, 261: 427-433). These systems were not used to process biomass or its components.

The particular ILs that can be used to prepare multi-IL systems for biomass processing are as disclosed above in the multiphasic fractioning process. For example, ILs for delignifiction are disclosed herein as are ILs for cellulose dissolution.

EXAMPLES

The following examples are set forth below to illustrate the methods and results according to the disclosed subject matter. These examples are not intended to be inclusive of all aspects of the subject matter disclosed herein, but rather to illustrate representative methods and results. These examples are not intended to exclude equivalents and variations of the present invention which are apparent to one skilled in the art.

Efforts have been made to ensure accuracy with respect to numbers (e.g., amounts, temperature, pH, etc.) but some errors and deviations should be accounted for. Unless indicated otherwise, parts are parts by weight, temperature is in ° C. or is at ambient temperature, and pressure is at or near atmospheric. There are numerous variations and combinations of conditions, e.g., component concentrations, temperatures, pressures, and other reaction ranges and conditions that can be used to optimize the product purity and yield obtained from the described process. Only reasonable and routine experimentation will be required to optimize such process conditions.

Certain materials, compounds, compositions, and components disclosed herein can be obtained commercially or readily synthesized using techniques generally known to those of skill in the art. For example, the starting materials and reagents used in preparing the disclosed compounds and compositions are either available from commercial suppliers such as Aldrich Chemical Co., (Milwaukee, Wis.), Acros Organics (Morris Plains, N.J.), Fisher Scientific (Pittsburgh, Pa.), or Sigma (St. Louis, Mo.) or are prepared by methods known to those skilled in the art following procedures set forth in references such as Fieser and Fieser's Reagents for Organic Synthesis, Volumes 1-17 (John Wiley and Sons, 1991); Rodd's Chemistry of Carbon Compounds, Volumes 1-5 and Supplementals (Elsevier Science Publishers, 1989); Organic Reactions, Volumes 1-40 (John Wiley and Sons, 1991); March's Advanced Organic Chemistry, (John Wiley and Sons, 4th Edition); and Larock's Comprehensive Organic Transformations (VCH Publishers Inc., 1989).

Example 1

The ionic liquid 1-butyl-3-methylimidazolium chloride ($C_4$mimCl) and a series of PEG polymers were chosen to examine miscibility of the two components. PEGs of different molecular weights were mixed with $C_4$mimCl at weight ratios (wt:wt) of 50:50 at around 80° C. in an oven with occasional vortexing. In each case, the mixtures were completely miscible at or around 80° C.

Figure 2A:
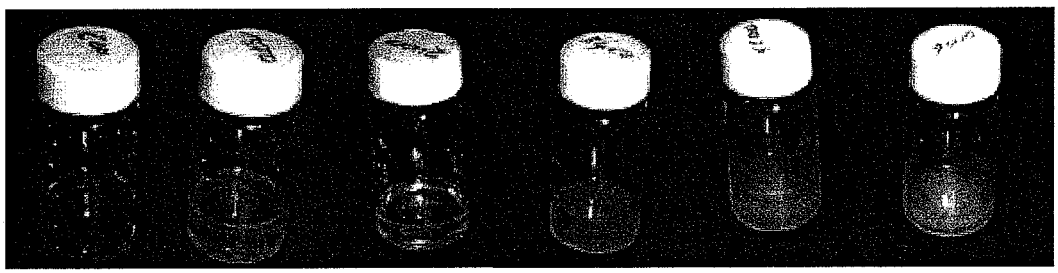
FIG. 2A is a photograph of mixtures of $C_4$mimCl and, from left to right, PEG 300, 600, 2000, 3400, 4600, and 8000 at about 80° C.
Figure 2B:
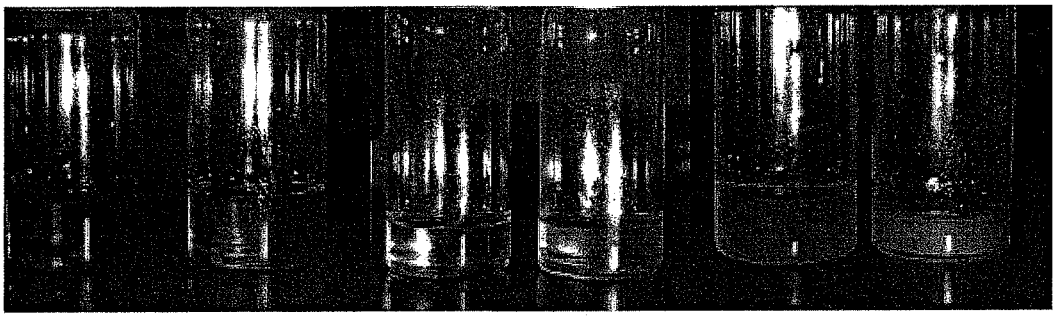
FIG. 2B is a photograph of mixtures of $C_4$mimCl and, from left to right, PEG 300, 600, 2000, 3400, 4600, and 8000 at about 60° C. after centrifugation.
Figure 2C:
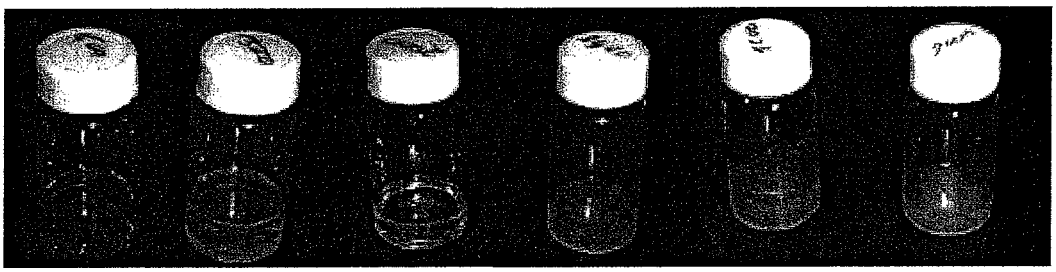
FIG. 2C is a photograph of mixtures of $C_4$mimCl and, from left to right, PEG 300, 600, 2000, 3400, 4600, and 8000 after cooling to about 24° C. from about 80° C.
Figure 3:
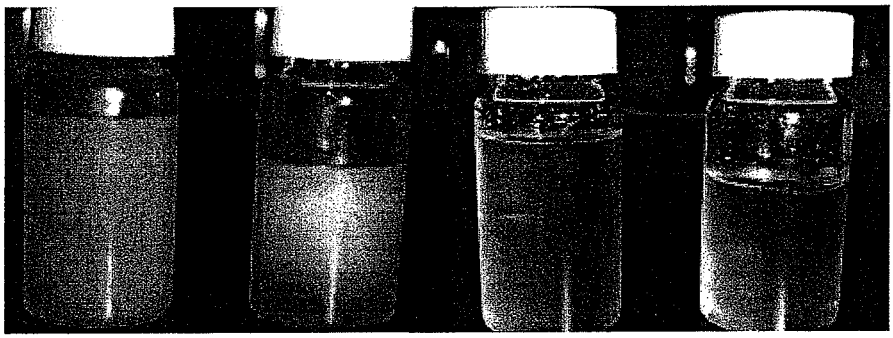
FIG. 3 is a photograph of mixtures of $C_4$mimCl and PEG 3400 ($1^{st}$ and $3^{rd}$ from left) and $C_4$mimCl and PEG 4600 ($2^{nd}$ and $4^{th}$ from left).
Figure 4:
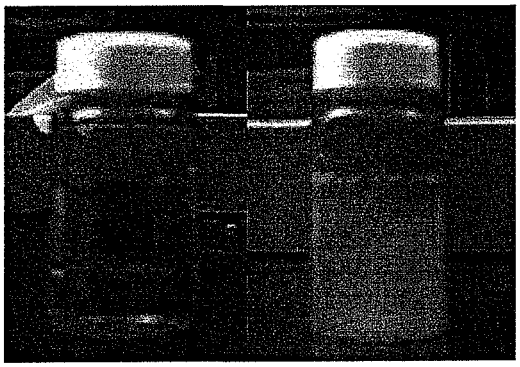
FIG. 4 is a photograph of ionic liquid/PEG with (right) and without (left) the addition of microcrystalline cellulose.
Figure 5:
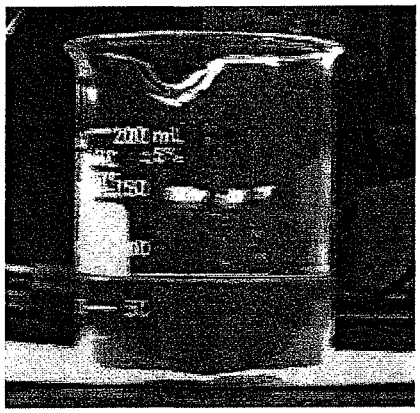
FIG. 5 is a photograph of a phase separated mixture of wood in a PEG 3400/$C_4$mimCl solution.
Figure 6:
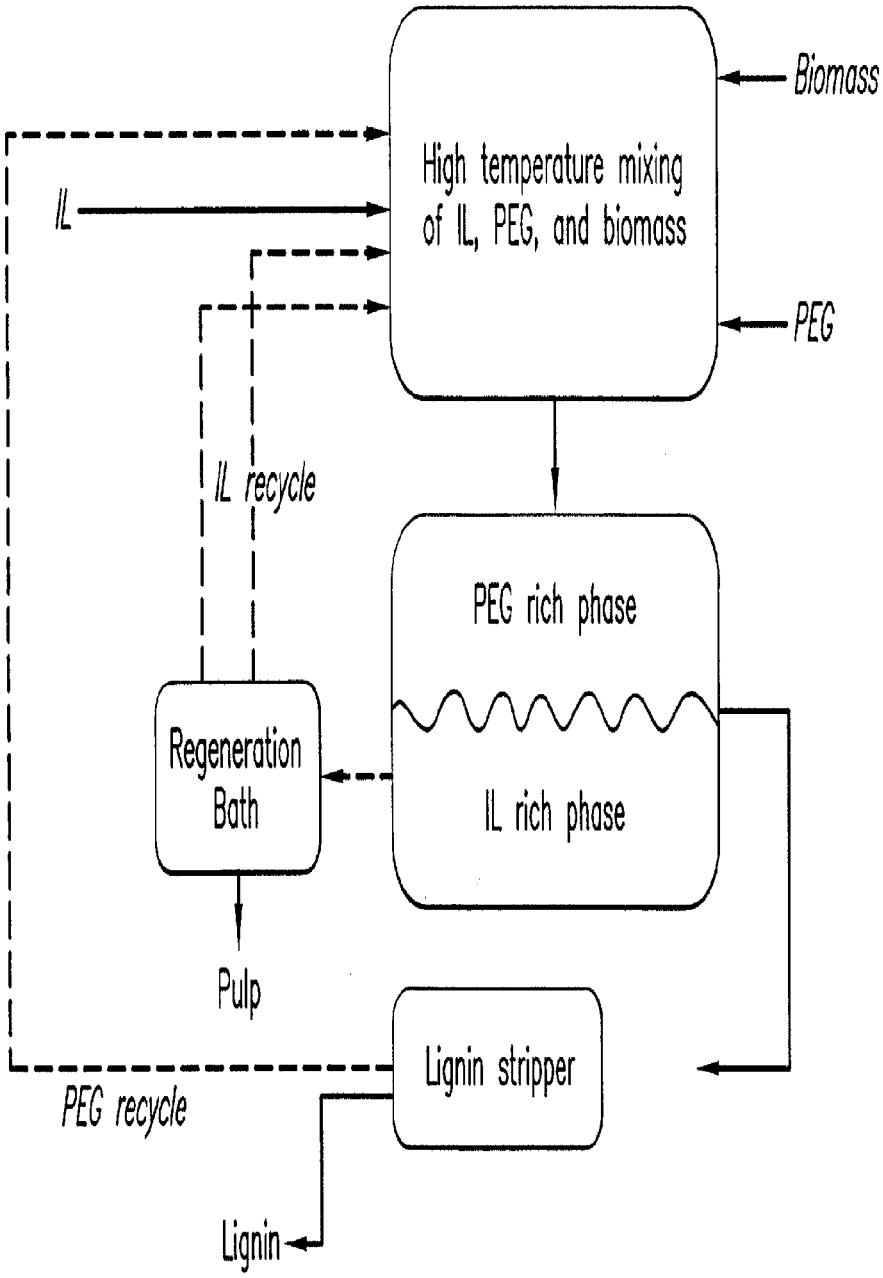
FIG. 6 is a flow diagram of a semi-continuous process for lignocellulosic biomass fractionation using a biphasic ionic liquid-PEG composition.

When the mixtures were cooled to room temperature, at or around 24° C., PEG 300, PEG 600, and PEG 2000 and the ionic liquid did not form immiscible compositions. For the remaining mixtures comprising PEG polymers of greater molecular weights, however, two phase systems were observed. Table 3 summarizes the results. FIGS. 2A-C are photographs of examples of these compositions.

TABLE 3

Number of observed phases in mixtures of $C_4$mimCl and different PEG samples.

| PEG sample | ~80° C. mixed | ~60° C. centrifuged | ~24° C. settled |
|---|---|---|---|
| 300 | 1 | 1 | 1 |
| 600 | 1 | 1 | 1 |
| 2000 | 1 | 1 | 1 |
| 3400 | 1 | 2 | 2 |
| 4600 | 1 | 2 | 2 |
| 8000 | 1 | 2 | 2 |

Example 2

The following experiments fractionate lignocellulosic materials from wood using PEG and $C_4$mimCl. Southern yellow pine wood chips of about 500 to about 1000 micrometers in size were added to a mixture of about a 2:1 (wt:wt) ratio of $C_4$mimCl to PEG 3400 using about 46 g of $C_4$mimCl and about 23 g of PEG 3400. About 1.4 g (about 2% of the total composition, by weight) of wood was added to the solution of ionic liquid and PEG. The resulting composition was heated to about 85° C. for about 20 hr with mixing. The solution was then left overnight to allow for phase separation. A two phase composition was observed within a few hours. After standing overnight, a two phase composition was seen clearly with the naked eye.

Similar experiments were carried out using other ionic liquids and PEG polymers. For example, $C_2$mimCl and PEG polymers with molecular weights of about at least 2000 were studied. Many of these compositions were observed to be phase separated after a similar treatment as previously described. For example, in a specific experiment, about 1 g of wood chips of from about 250 to about 500 micrometers in size were added to a liquid solution of a 50:50 (wt:wt) mixture of $C_2$mimCl and PEG 2000 (about 50 g of each). The resulting composition was stirred for 17 hr at about 85° C. After which, the mixture was left at 85° C. without stirring, at which time phase separation was observed.

Example 3

1 g of southern yellow pine sawdust and 0.05 g of a polyoxometalate (POM), $H_5[PV_2Mo_{10}O_{40}]$, were added to 25 g of trihexyl(tetradecyl)phosphonium chloride ($P_{66614}Cl$) and the mixture was heated at about 100° C. under nitrogen environment. POMs are typically used as catalysts for delignification of lignocellulosic biomass and require inert environment for activation (Weinstock et al., "A new environmentally benign technology for transforming wood pulp into paper—Engineering polyoxometalates as catalysts for multiple processes," *J Molecular Catalysis A, Chem* 1997, 116:59-84). Delignification of softwood was observed and components were regenerated separately.

Example 4

1 g of southern yellow pine sawdust and 0.2 g of $H_5[PV_2Mo_{10}O_{40}]$ were added to 20 g of 1-ethyl-3-methyimidazolium acetate ($C_2$mimOAc). The mixture was heated at 100° C. under nitrogen environment. Components of biomass were dissolved while delignification occurred simultaneously. Dissolved cellulose was regenerated in acetone/water (1:1) bath while lignin was precipitated from the solution by evaporation of acetone, followed by centrifugation. Compared to cellulose regenerated without POM under similar conditions, cellulose regenerated with POM contained less lignin and the dissolution was enhanced by 17%.

Example 5

A mixture of 10 g of $C_2$mimOAc and 1-ethyl-3-methyimidazolium docusate ($C_2$mimDoc) (each) and 0.5 g of southern yellow pine sawdust was heated at about 100° C. and stirred for 16 h. The solution turned brown indicating dissolution of wood and the two ILs phase separated with dissolved components of wood upon storing at room temperature.

Example 6

About 3 g of PEG-2000 and about 4.5 g of $C_2$mimCl were stirred and then allowed to settle down, at a constant temperature, observing two distinct phases. A sample of each phase was taken and its composition was analyzed. The same procedure was repeated at other temperatures. The composition of the phases in equilibrium at each of the studied temperatures is reported in the Table 1. The biphasic region of the binary system investigated is shown in the temperature-composition diagram of FIG. 1.

Specific Embodiments

Disclosed herein are compositions and methods comprising a fractionation composition comprising biomass, an ionic liquid, and a polyalkylene glycol and the use of such a fractionation composition.

Disclosed are methods of fractioning biomass comprising using a fractionation composition comprising biomass, an ionic liquid, and a polyalkylene glycol, wherein the fractionation composition is monophasic at a particular temperature and biphasic at an adjusted temperature. The adjusted temperature of such a fractionation composition can be attained, in various examples, by cooling to less than about 60° C., 30° C., or ambient temperature. In a further example, a portion of the biomass can become fractioned between each phase of a biphasic composition. Each phase of such a biphasic composition can also be separated, and the components of each phase can optionally be retrieved from the mixture.

A fractionation composition can be provided by admixing the biomass, ionic liquid, and polyalkylene glycol. The fractionation composition can be heated, in various examples, to about 65° C., 75° C., or 85° C. through the use of any heating source. For example, a fractionation composition comprising biomass, an ionic liquid, and a polyalkylene glycol can be heated by microwave irradiation.

The fractionation composition can further comprise other additives, including catalysts, surfactants, preservatives, antimicrobials, or combinations thereof.

The ratio of ionic liquid to polyalkylene glycol in a fractionation composition can be from about 10:1 to about 1:10. In one example, the ratio of ionic liquid to polyalkylene glycol in the fractionation composition can be 1:1. In another example, the ratio of ionic liquid to polyalkylene glycol in the fractionation composition can be 2:1. In yet another example, the ratio of ionic liquid to polyalkylene glycol in the fractionation composition can be 1:2.

The fractionation composition comprising biomass, an ionic liquid, and a polyalkylene glycol can also be substantially free of water.

In various examples of the disclosed subject matter, the biomass can comprise a lignocellulosic material, such as wood pulp or southern yellow pine.

The fractionation composition comprising biomass, and a polyalkylene glycol can comprise an ionic liquid that is molten at a temperature of less than about 150° C. In further examples, the ionic liquid can be molten at a temperature of from about −44° C. to about 120° C. The ionic liquid, in various examples, can also be substantially free of a nitrogen-comprising base.

The ionic liquid present in the fractionation composition can comprise one or more cations and one or more anions, both of which are described in detail above, wherein the cations are chosen from pyrazole, thiazole, isothiazole, azathiozole, oxothiazole, oxazine, oxazoline, oxazaborole, dithiozole, triazole, selenozole, oxaphosphole, pyrrole, borole, furan, thiophen, phosphole, pentazole, indole, indoline, imidazole, oxazole, isoxazole, isotriazole, tetrazole, benzofuran, dibenzofuran, benzothiophen, dibenzothiophen, thiadiazole, pyridine, pyrimidine, pyrazine, pyridazine, piperazine, piperidine, morpholone, pyran, annoline, phthalazine, quinazoline, quinoxaline, pyrrolidine, phosphonium, or combinations thereof. Further, the ionic liquid can comprise anions, wherein the anions are chosen from $F^-$, $Cl^-$, $Br^-$, $I^-$, $ClO_4^-$, $BF_4^-$, $PF_6^-$, $AsF_6^-$, $SbF_6$, $NO_2^-$, $NO_3^-$, $SO_4^{2-}$, $PO_4^{3-}$, $HPO_4^{2-}$, $CF_3CO_2^-$, $CO_3^{2-}$, or $C_1$-$C_6$ carboxylate. Carboxylate anions that comprise 1-6 carbon atoms ($C_1$-$C_6$ carboxylate) are illustrated by formate, acetate, propionate, butyrate, hexanoate, maleate, fumarate, oxalate, lactate, pyruvate, and the like, are also suitable for appropriate contemplated ionic liquid cations. Anions also include perchlorate, a pseudohalogen such as thiocyanate and cyanate. Sulfate anions, such as tosylate, mesylate, and docusate, are also suitable for use as the anionic component of an ionic liquid. Still other examples of anions that can be present in the disclosed compositions include, but are not limited to, other sulfates, sulfites, phosphates, phosphites, nitrate, nitrites, hypochlorite, chlorite, perchlorate, bicarbonates, and the like, including mixtures thereof. Any combination of anions and cations disclosed in this description is contemplated for use in an ionic liquid/polyalkylene glycol fractionation composition.

The herein disclosed polyalkylene glycols can have a molecular weight of at least about 2000 Daltons, 4000 Daltons, 6000 Daltons, or 8000 Daltons, or combinations thereof. In some examples, the polyalkylene glycol can be polyethylene glycol, polypropylene glycol, or combinations thereof.

Disclosed herein is also a fractionation composition comprising biomass, an ionic liquid, and a polyalkylene glycol, wherein the composition is biphasic. A fractionation composition can further comprise a catalyst, surfactant, preservative, anti-microbial, or a combination thereof. The ratio of ionic liquid to polyalkylene glycol in the fractionation composition can be from about 10:1 to about 1:10. In one example, the ratio of ionic liquid to polyalkylene glycol in the fractionation composition is 1:1. In another example, the ratio of ionic liquid to polyalkylene glycol in the fractionation composition is 2:1. In yet another example, the ratio of ionic liquid to polyalkylene glycol in the fractionation composition is 1:2. A fractionation composition can also be substantially free of water. Likewise, a fractionation composition can be substantially free of a nitrogen-comprising base.

A fractionation composition can comprise biomass comprising a lignocellulosic material. In a specific example, a fractionation composition can comprise wood pulp. In another example, a fractionation composition can comprise southern yellow pine.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of fractioning biomass, comprising:

a. providing a liquid fractionation composition comprising the biomass, an ionic liquid, and a fractionation polymer, with a weight ratio of the fractionation polymer to the ionic liquid of about 5:95 to about 95:5 wherein the liquid fractionation composition is substantially free of water and wherein the liquid fractionation composition is mono-phasic at a temperature; and b. adjusting the temperature of the mono-phasic liquid fractionation composition to form a biphasic liquid fractionation composition that comprises a fractionation polymer rich liquid phase and an ionic liquid rich liquid phase, wherein the biomass is fractioned between the phases of the biphasic liquid composition.

2. The method of claim 1, wherein the mono-phasic fractionation composition of step a is formed by treating a mixture of the biomass, the ionic liquid, and the fractionation polymer with heating, microwave radiation, infrared irradiation, or ultrasound irradiation.

3. The method of claim 1, wherein the temperature adjustment of step b is by cooling.

4. The method of claim 1, wherein the ratio of ionic liquid to fractionation polymer is from about 10:1 to about 1:10.

5. The method of claim 1, wherein the biomass comprises a lignocellulosic material wherein the fractionation polymer rich liquid phase comprises lignin from the biomass and the ionic liquid rich liquid phase comprises cellulose from the biomass.

6. The method of claim 1, wherein the biomass is a crustacean biomass.

7. The method of claim 1, wherein the ionic liquid is molten at a temperature of from about −44° C. to about 120° C.

8. The method of claim 1, wherein the ionic liquid is substantially free of a nitrogen-comprising base.

9. The method of claim 1, wherein the ionic liquid comprises one or more cations and one or more anions and wherein the cations comprise one or more compounds having the formula

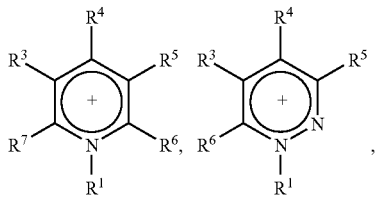

-continued

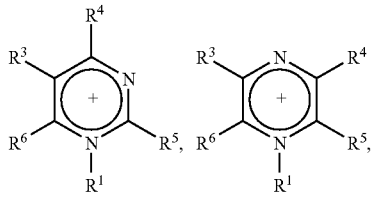

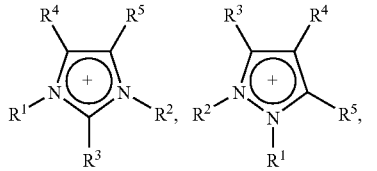

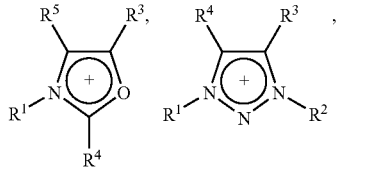

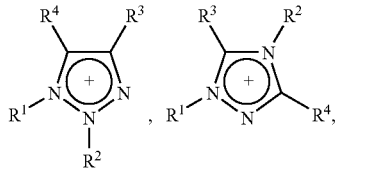

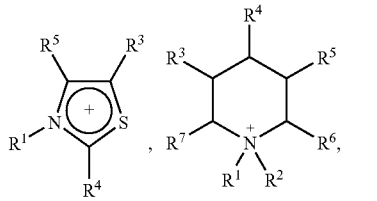

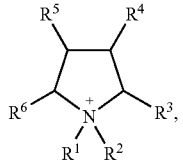

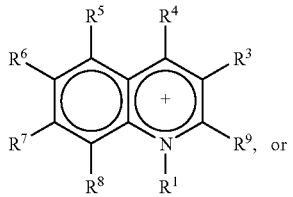

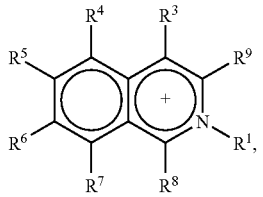

wherein $R^1$ and $R^2$ are independently a $C_1$-$C_6$ alkyl group or a $C_1$-$C_6$ alkoxyalkyl group, and $R^3$, $R^4$, $R^5$, $R^6$, $R^7$, $R^8$, and $R^9$ are independently H, a $C_1$-$C_6$ alkyl, a $C_1$-$C_6$ alkoxyalkyl group, or a $C_1$-$C_6$ alkoxy group, and the anions comprise $F^-$, $Cl^-$, $Br^-$, $I^-$, $ClO_4^-$, $BF_4^-$, $PF_6^-$, $AsF_6^-$, $SbF_6$, $NO_2^-$, $NO_3^-$, $SO_4^{2-}$, $PO_4^{3-}$, $HPO_4^{2-}$, $CF_3CO_2^-$, $CO_3^{2-}$, or $C_1$-$C_6$ carboxylate.

10. The method of claim 1, wherein ionic liquid comprises one or more cations and one or more anions and wherein the one or more cations comprise one or more compounds having the formula:

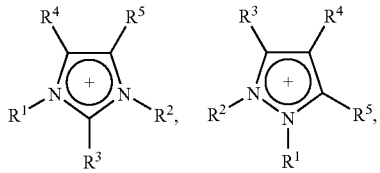

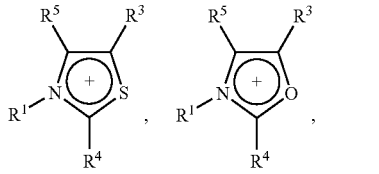

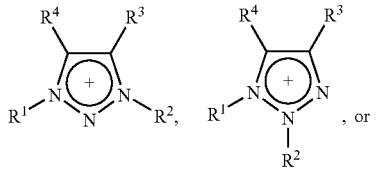

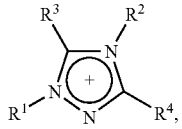

wherein $R^1$ and $R^2$ are independently a $C_1$-$C_6$ alkyl group or a $C_1$-$C_6$ alkoxyalkyl group, and $R^3$, $R^4$, and $R^5$ are independently H, a $C_1$-$C_6$ alkyl group, a $C_1$-$C_6$ alkoxyalkyl group, or a $C_1$-$C_6$ alkoxy group, and the anions comprise one or more of $F^-$, $Cl^-$, $Br^-$, $I^-$, $ClO_4^-$, $BF_4^-$, $PF_6^-$, $AsF_6^-$, $SbF_6$, $NO_2^-$, $NO_3^-$, $SO_4^{2-}$, $PO_4^{3-}$, $HPO_4^{2-}$, $CF_3CO_2^-$, $CO_3^{2-}$, or $C_1$-$C_6$ carboxylate.

11. The method of claim 10, wherein the one or more cations comprise an imidazolium ion having the formula:

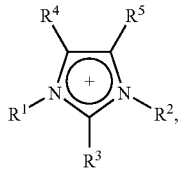

wherein $R^1$ and $R^2$ are $C_1$-$C_6$ alkyl and $R^3$, $R^4$, and $R^5$ each are H.

12. The method of claim 1, wherein the ionic liquid comprises 1-($C_1$-$C_6$ alkyl)-3-methyl-imidazolium halide or 1-($C_1$-$C_6$ alkyl)-3-methyl-imidazolium $C_1$-$C_6$ carboxylate.

13. The method of claim 1, wherein the fractionation polymer comprises a polyalkylene glycol.

14. The method of claim 13, wherein the polyalkylene glycol comprises polyethylene glycol or polypropylene glycol.

15. The method of claim 1, wherein the fractionation polymer comprises polyethyleneimine, polybutyletheramine, poly(N-isopropylacrylamide), a copolymer of poly(N-isopropylacrylamide) with polyvinylimidazole, pectin, Ficoll, hydroxypropyl starch, polyvinyl alcohol, a copolymer of polyvinyl alcohol with polyvinylimidazole, polyvinylcaprolactam, polyvinylpyrrolidone, protein, oligopeptide, mixture and ester derivatives thereof.

16. The method of claim 5, further comprising generating cellulose from the ionic liquid rich liquid phase.

17. The method of claim 16, further comprising regenerating ionic liquid after generating cellulose.

18. The method of claim 5, further comprising stripping lignin from the fractionation polymer rich liquid phase.

19. The method of claim 18, further comprising recycle the fractionation polymer after stripping lignin.

20. A liquid fractionation composition, comprising: biomass, an ionic liquid, and a fractionation polymer, with a weight ratio of the fractionation polymer to the ionic liquid of about 5:95 to about 95:5 wherein the composition is a biphasic liquid composition that comprises a fractionation polymer rich liquid phase and an ionic liquid rich liquid phase with the biomass fractioned between the phases of the biphasic liquid composition and wherein the composition is substantially free of water.

21. The composition of claim 20, wherein the fractionation polymer rich liquid phase comprises lignin from the biomass and the ionic liquid rich liquid phase comprises cellulose from the biomass.

22. The composition of claim 21, wherein the ratio of ionic liquid to fractionation polymer is from about 10:1 to about 1:10.

23. The composition of claim 21, wherein the biomass comprises a lignocelullosic material.

24. The composition of claim 21, wherein the biomass comprises southern yellow pine.

25. The composition of claim 21, wherein the biomass is a crustacean biomass.

26. The composition of claim 21, wherein the ionic liquid is substantially free of a nitrogen-comprising base.

27. The composition of claim 21, wherein the ionic liquid comprises one or more cations and one or more anions and wherein the cations comprise one or more compounds having the formula

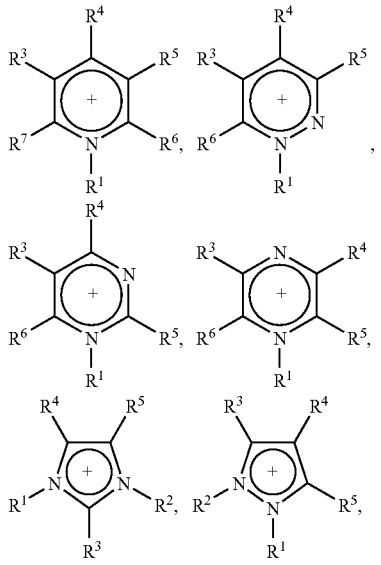

-continued

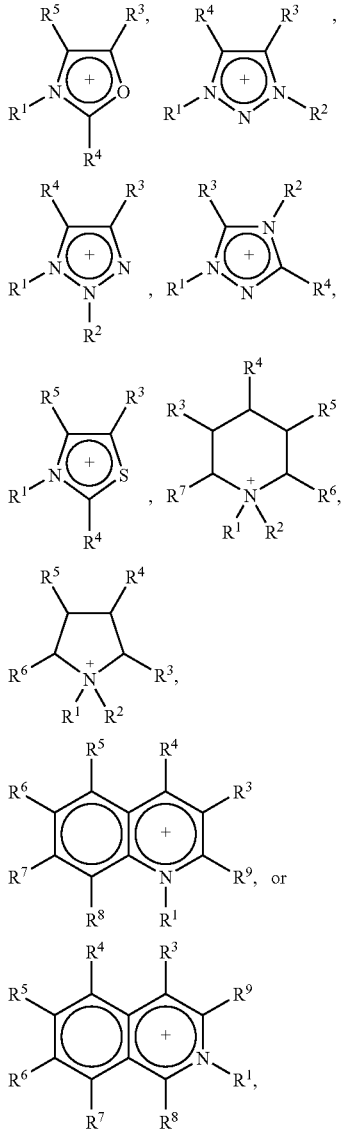

wherein $R^1$ and $R^2$ are independently a $C_1$-$C_6$ alkyl group or a $C_1$-$C_6$ alkoxyalkyl group, and $R^3$, $R^4$, $R^5$, $R^6$, $R^7$, $R^8$, and $R^9$ are independently H, a $C_1$-$C_6$ alkyl, a $C_1$-$C_6$ alkoxyalkyl group, or a $C_1$-$C_6$ alkoxy group, and the anions comprise F, $Cl^-$, $Br^-$, $I^-$, $ClO_4^-$, $BF_4^-$, $PF_6^-$, $AsF_6^-$, $SbF_6$, $NO_2^-$, $NO_3^-$, $SO_4^{2-}$, $PO_4^{3-}$, $HPO_4^{2-}$, $CF_3CO_2^-$, $CO_3^{2-}$, or $C_1$-$C_6$ carboxylate.

28. The composition of claim 21, wherein ionic liquid comprises one or more cations and one or more anions and wherein the one or more cations comprise one or more compounds having the formula:

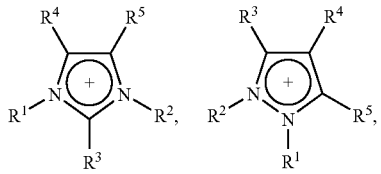

-continued

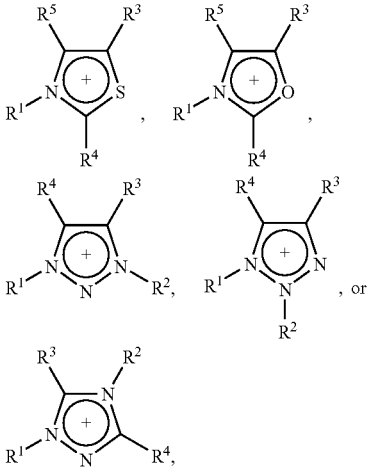

wherein $R^1$ and $R^2$ are independently a $C_1$-$C_6$ alkyl group or a $C_1$-$C_6$ alkoxyalkyl group, and $R^3$, $R^4$, and $R^5$ are independently H, a $C_1$-$C_6$ alkyl group, a $C_1$-$C_6$ alkoxyalkyl group, or a $C_1$-$C_6$ alkoxy group, and the anions comprise one or more of F, $Cl^-$, Br, $I^-$, $ClO_4^-$, $BF_4^-$, $PF_6^-$, $AsF_6^-$, $SbF_6$, $NO_2^-$, $NO_3^-$, $SO_4^{2-}$, $PO_4^{3-}$, $HPO_4^{2-}$, $CF_3CO_2^-$, $CO_3^{2-}$, or $C_1$-$C_6$ carboxylate.

29. The composition of claim 28, wherein the one or more cations comprise an imidazolium ion having the formula:

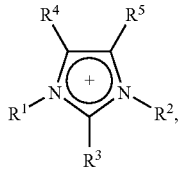

wherein $R^1$ and $R^2$ are $C_1$-$C_6$ alkyl and $R^3$, $R^4$, and $R^5$ each are H.

30. The composition of claim 21, wherein the ionic liquid comprises 1-($C_1$-$C_6$ alkyl)-3-methyl-imidazolium halide or 1-($C_1$-$C_6$ alkyl)-3-methyl-imidazolium $C_1$-$C_6$ carboxylate.

31. The composition of claim 21, wherein the fractionation polymer comprises a polyalkylene glycol.

32. The composition of claim 31, wherein the polyalkylene glycol comprises polyethylene glycol or polypropylene glycol.

33. The composition of claim 21, wherein the fractionation polymer comprises polyethyleneimine, polybutyletheramine, poly(N-isopropylacrylamide), a copolymer of poly(N-isopropylacrylamide) with polyvinylimidazole, pectin, Ficoll, hydroxypropyl starch, polyvinyl alcohol, a copolymer of polyvinyl alcohol with polyvinylimidazole, polyvinylcaprolactam, polyvinylpyrrolidone, protein, oligopeptide, mixture and ester derivatives thereof.

* * * * *